US007762356B2

(12) United States Patent
Turner et al.

(10) Patent No.: US 7,762,356 B2
(45) **Date of Patent: *Jul. 27, 2010**

(54) ROTARY STEERABLE MOTOR SYSTEM FOR UNDERGROUND DRILLING

(75) Inventors: William E. Turner, Durham, CT (US); Carl A. Perry, Middletown, CT (US); Mark E. Wassell, Kingwood, TX (US); Jason R. Barbely, Middletown, CT (US); Daniel E. Burgess, Middletown, CT (US); Martin E. Cobern, Cheshire, CT (US)

(73) Assignee: APS Technology, Inc., Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/125,747

(22) Filed: May 22, 2008

(65) Prior Publication Data

US 2009/0008151 A1 Jan. 8, 2009

Related U.S. Application Data

(63) Continuation of application No. 11/117,802, filed on Apr. 29, 2005, now Pat. No. 7,389,830.

(51) Int. Cl.
*E21B 7/06* (2006.01)

(52) U.S. Cl. ..... 175/61

(58) Field of Classification Search ..... 175/61, 175/73, 74, 76

See application file for complete search history.

(56) References Cited

U.S. PATENT DOCUMENTS

| | | | | |
|---|---|---|---|---|
| 6,050,346 | A | 4/2000 | Hipp | 173/78 |
| 6,089,332 | A | 7/2000 | Barr et al. | 175/45 |
| 6,102,681 | A | 8/2000 | Turner | 418/48 |
| 6,105,690 | A | 8/2000 | Biglin, Jr. et al. | 175/48 |
| 6,230,823 | B1 | 5/2001 | Sieniawski | 175/107 |
| 6,257,356 | B1 | 7/2001 | Wassell | 175/61 |
| 6,328,119 | B1 * | 12/2001 | Gillis et al. | 175/325.1 |
| 6,392,561 | B1 | 5/2002 | Davies et al. | 340/854.3 |
| 6,595,303 | B2 * | 7/2003 | Noe et al. | 175/74 |

(Continued)

FOREIGN PATENT DOCUMENTS

EP 0 530 045 A1 3/1993

(Continued)

OTHER PUBLICATIONS

Catalog: Schlumberger PowerDrive vorteX, Mar. 2005, 5 pages.

(Continued)

*Primary Examiner*—William P Neuder
(74) *Attorney, Agent, or Firm*—Woodcock Washburn LLP

(57) ABSTRACT

A preferred embodiment of a system for rotating and guiding a drill bit in an underground bore includes a drilling motor and a drive shaft coupled to drilling motor so that drill bit can be rotated by the drilling motor. The system further includes a guidance module having an actuating arm movable between an extended position wherein the actuating arm can contact a surface of the bore and thereby exert a force on the housing of the guidance module, and a retracted position.

28 Claims, 25 Drawing Sheets

U.S. PATENT DOCUMENTS

| | | | | |
|---|---|---|---|---|
| 6,626,254 | B1 | 9/2003 | Krueger et al. | 175/61 |
| 6,659,200 | B1 | 12/2003 | Eppink | 175/61 |
| 6,714,138 | B1 | 3/2004 | Turner et al. | 340/854.3 |
| 7,327,634 | B2 | 2/2008 | Perry et al. | 367/84 |
| 7,389,830 | B2 * | 6/2008 | Turner et al. | 175/61 |
| 2004/0016571 | A1 | 1/2004 | Kruger | 175/61 |
| 2006/0215491 | A1 | 9/2006 | Hall | 367/83 |
| 2006/0260843 | A1 | 11/2006 | Cobern | 175/45 |

FOREIGN PATENT DOCUMENTS

| | | | |
|---|---|---|---|
| EP | 0 540 045 | A1 | 5/1993 |
| EP | 0 770 760 | A1 | 5/1997 |
| EP | 0 874 128 | A2 | 10/1998 |
| GB | 2 259 316 | A | 3/1993 |
| GB | 2 408 526 | A | 6/2005 |
| GB | 2 410 042 | A | 7/2005 |
| WO | 01/25586 | A1 | 4/2001 |

OTHER PUBLICATIONS

Catalog: Schlumberger PowerDrive Xtra Series, Oct. 2002, 7 pages.
Durant, Slimhole Rotary Steerable System Now A Reality Drilling Contractor, Jul.-Aug. 2002, pp. 24-25.
Drilling Contractor, Statoil Saves Big with New Rotary Steerable System, Mar.-Apr. 2004, p. 44.
Schlumberger, PowerDrive Xtra 475 Rotary Steerable System, SMP-5897-1, Dec. 2002, 2 pgs.
In the United States Patent and Trademark Office, in Re. U.S. Appl. No. 11/117,802, Non-final Office Action dated May 15, 2007.

* cited by examiner

ROTARY STEERABLE MOTOR SYSTEM FOR UNDERGROUND DRILLING

CROSS REFERENCE TO RELATED APPLICATION

This application is a continuation of U.S. patent application Ser. No. 11/117,802 filed Apr. 29, 2005, now allowed.

Pursuant to 35 U.S.C. §202(c), it is acknowledged that the U.S. government may have certain rights to the invention described herein, which was made in part with funds from the U.S. Department of Energy National Energy, Grant No. DE-FG02-02ER83368.

FIELD OF THE INVENTION

The present invention relates to underground drilling. More specifically, the invention relates to a system for rotating and guiding a drill bit as the drill bit forms an underground bore.

BACKGROUND OF THE INVENTION

Underground drilling, such as gas, oil, or geothermal drilling, generally involves drilling a bore through a formation deep in the earth. Such bores are formed by connecting a drill bit to long sections of pipe, referred to as a "drill pipe," so as to form an assembly commonly referred to as a "drill string." The drill string extends from the surface, to the bottom of the bore.

The drill bit is rotated so that the drill bit advances into the earth, thereby forming the bore. In a drilling technique commonly referred to as rotary drilling, the drill bit is rotated by rotating the drill string at the surface. In other words, the torque required to rotate the drill bit is generated aboveground, and is transferred to the drill bit by way of the drill string.

Alternatively, the drill bit can be rotated by a drilling motor. The drilling motor is usually mounted in the drill string, proximate the drill bit. The drill bit can be rotated by the drilling motor alone, or by rotating the drill string while operating the drilling motor.

One type of drilling motor known as a "mud motor" is powered by drilling mud. Drilling mud is a high pressure fluid that is pumped from the surface, through an internal passage in the drill string, and out through the drill bit. The drilling mud lubricates the drill bit, and flushes cuttings from the path of the drill bit. The drilling mud then flows to the surface through an annular passage formed between the drill string and the surface of the bore.

In a drill string equipped with a mud motor, the drilling mud is routed through the drilling motor. The mud motor is equipped with a rotor that generates a torque in response to the passage of the drilling mud therethrough. The rotor is coupled to the drill bit so that the torque is transferred to the drill bit, causing the drill bit to rotate.

So called "smart" drilling systems include sensors located down hole, in the drill string. The information provided by these sensors permits the drill-string operator to monitor relevant properties of the geological formations through which the drill string penetrates. Based on an analysis of these properties, the drill string operator can decide to guide the drill string in a particular direction. In other words, rather than following a predetermined trajectory, the trajectory of the drill string can be adjusted in response to the properties of the underground formations encountered during the drilling operation. The technique is referred to as "geosteering."

Various techniques have been developed for performing both straight hole and directional (steered) drilling, without a need to reconfigure the bottom hole assembly of the drill string, i.e., the equipment located at or near the down-hole end of the drill string. For example, so called steerable systems use a drilling motor with a bent housing in the drilling motor. A steerable system can be operated in a sliding mode in which the drill string is not rotated, and the drill bit is rotated exclusively by the drilling motor. The bent housing or subassembly steers the drill bit in the desired direction as the drill string slides through the bore, thereby effectuating directional drilling. Alternatively, the steerable system can be operated in a rotating mode in which the drill string is rotated while the drilling motor is running. This technique results in a substantially straight bore.

Although steerable systems have been used for many years, these types of systems possess disadvantages. For example, when a steerable system is operated in the sliding mode, the rate of penetration of the drill bit can be relatively low, and stick slip, differential sticking, and difficulties with cuttings removal can be prevalent. Operating a steerable system in the rotating mode can result in an oversize and tortuous bore.

So-called rotary steerable tools have been used over the past several years to perform straight-hole and directional drilling. One particular type of rotary steerable system can include pads located on the drill string, proximate the drill bit. The pads can extend and retract with each revolution of the drill string. Contact the between the pads and the surface of the drill hole exerts a lateral force on the string. This force pushes or points the drill bit in the desired direction of drilling. Straight-hole drilling is achieved when the pads remain in their retracted positions.

Rotary steerable tools can form an in-gauge bore while drilling directionally, and do not posses the disadvantages associated with sliding the drill string. The drill bit in a rotary steerable tool, however, is rotated exclusively by torque generated at the surface and transferred to the drill bit by way of the drill string. Thus, the torque available to rotate the drill string can be limited by drag on the drill string, especially in a highly-deviated bore. Moreover, the drill-bit torque can be further limited by the torque requirements of the hydraulic system that extends and retracts the pads during directional drilling.

SUMMARY OF THE INVENTION

A preferred embodiment of a system for rotating and guiding a drill bit in an underground bore comprises a drilling motor comprising a housing, and a rotor mounted in the housing so that the rotor rotates in relation of the housing. The system also comprises a drive shaft coupled to the rotor and the drill bit so that drill bit rotates in response to rotation of the rotor.

The system further comprises a guidance module comprising a housing coupled to the housing of the drilling motor so that the housing of the guidance module rotates with the housing of the drilling motor and the drive shaft extends through the housing of the guidance module. The guidance module also comprises an actuating arm mounted on the housing of the guidance module. The actuating arm is movable in relation to the housing of the guidance module between an extended position wherein the actuating arm can contact a surface of the bore and thereby exert a force on the housing of the guidance module, and a retracted position.

A preferred embodiment of a rotary steerable motor system for use in drilling an underground bore comprises a drilling motor capable of generating a torque, a drive shaft coupled to the drilling motor for transmitting the torque to a drill bit, and a guidance module. The guidance module comprises a housing having a portion of the drive shaft concentrically disposed therein, an actuating arm movably mounted on the housing; and a hydraulic system.

The hydraulic system comprises a pump having an outlet for discharging a pressurized hydraulic fluid, a piston disposed in a cylinder formed in the housing so that the piston can extend from the cylinder and urge the actuating arm away from the housing in response to the pressurized hydraulic fluid, and a valve for selectively placing the cylinder in fluid communication with the outlet of the pump.

Another preferred embodiment of a system for rotating and guiding a drill bit in an underground bore comprises a drilling motor capable of generating a torque, a drive shaft coupled to the drilling motor for transmitting the torque to a drill bit, and means coupled to the drive shaft for generating contact with a surface of the bore so that the contact urges the drive shaft in a direction other than a direction coinciding with an axis of rotation of the drive shaft.

A preferred embodiment of a rotary steerable drilling apparatus for drilling a bore hole through an earthen formation comprises a drill pipe comprised of a plurality of drill pipe sections, a first motor for rotating the drill pipe at a first RPM relative to the earthen formation, and a second motor mounted within the drill pipe so that rotation of the drill pipe by the first motor rotates the second motor at the first RPM.

The apparatus also includes a drive shaft coupled to the second motor and extending thru the drill pipe so that rotation of the drive shaft by the second motor rotates the drive shaft relative to the drill pipe at a second RPM, and a drill bit coupled to the drive shaft, whereby rotation of drill pipe by the first motor at the first RPM and rotation of the drive shaft by the second motor at the second RPM causes the drill bit to rotate relative to the earthen formation at rotational speed that is essentially the sum of the first RPM and the second RPM.

The apparatus further comprises a guidance module for controlling the direction in which the drill bit drills, the guidance module incorporated into the drill pipe so that the guidance module rotates with the drill pipe at the first RPM relative to the earthen formation.

A preferred method for forming an underground bore comprises rotating a drill collar at a first rotational speed using a first motor, and rotating a drill bit coupled to the drill collar so that the drill bit can rotate in relation to the drill collar, using a second motor, so that the drill bit rotates at a second rotational speed greater than the first rotational speed. The preferred method also comprises guiding a path of the drill bit by periodically extending and retracting actuating arms coupled to the drill collar and rotating at a rotational speed approximately equal to the rotational speed of the drill collar so that the actuating arms contact a surface of the underground bore.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF ILLUSTRATIVE EMBODIMENTS

Figure 1:
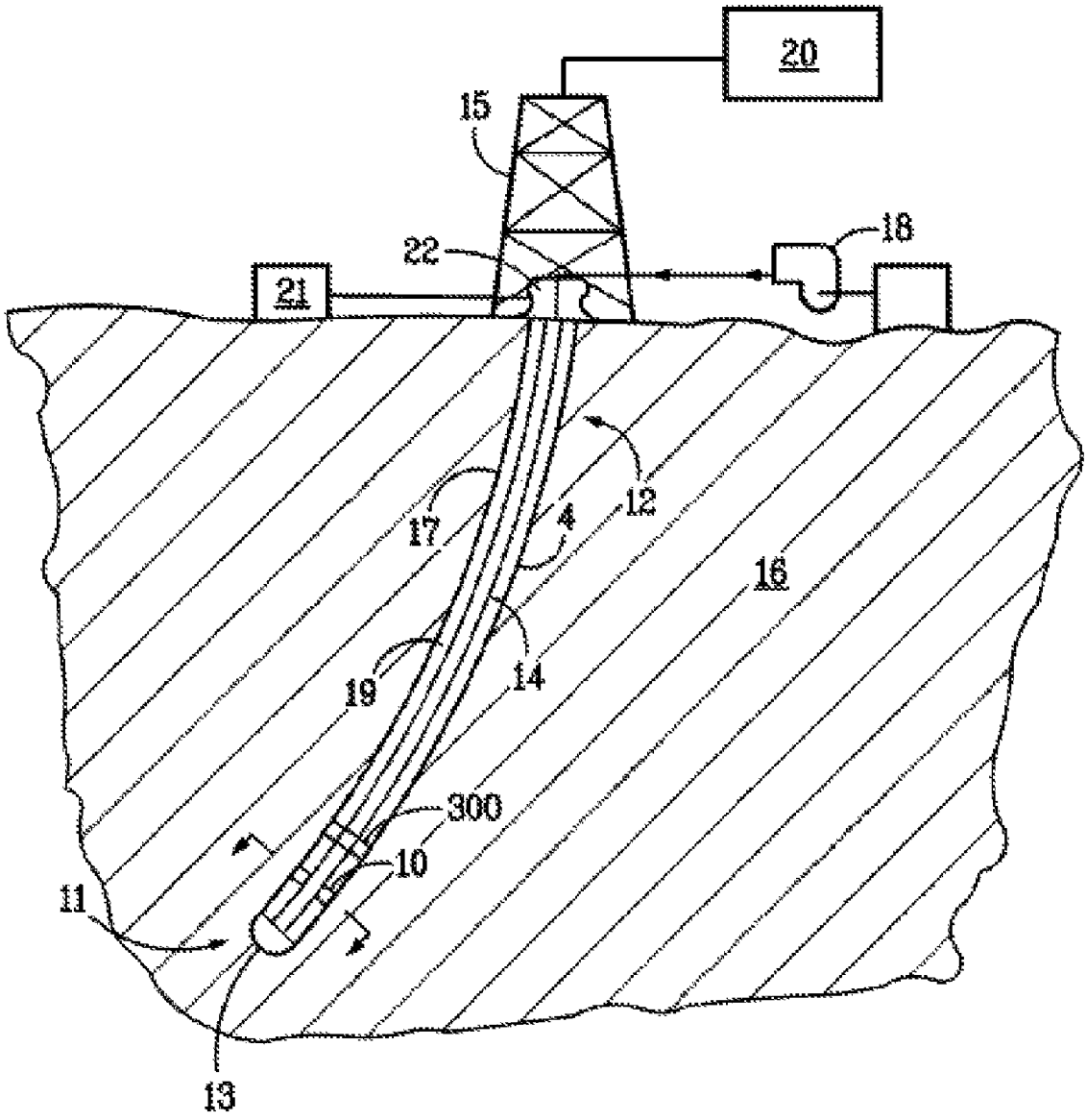
FIG. 1 is side view of a drill string equipped with a preferred embodiment of a rotary steerable motor system, depicting the drill string forming a bore in an earthen formation.

FIGS. 1 to 17 depict a preferred embodiment of a rotary steerable motor system 10. The system 10 forms part of a bottom hole assembly 11 of a drill string 12 (see FIG. 1). The bottom hole assembly 11 forms the down-hole end of the drill string 12, and includes a drill bit 13. The drill bit 13 preferably has side-cutting ability. The drill bit 13 is rotated, in part, by a drill collar 14. The drill collar 14 is formed by connecting relatively long sections of pipe, commonly referred to as "drill pipe." The length of the drill collar 14 can be increased as the drill string 12 progresses deeper into the earth formation 16, by connecting additional sections of drill pipe thereto.

The drill collar 14 is rotated by a motor 21 of a drilling rig 15 located on the surface. Drilling torque can be transmitted from the motor 21 to the drill bit 13 through a turntable 22, a kelly (not shown), and the drill collar 14. The rotating drill bit 13 advances into the earth formation 16, thereby forming a bore 17.

Drilling mud is pumped from the surface, through the drill collar 14, and out of the drill bit 13. The drilling mud is circulated by a pump 18 located on the surface. The drilling mud, upon exiting the drill bit 13, returns to the surface by way of an annular passage 19 formed between the drill collar 14 and the surface of the bore 17.

Operation of drilling rig 15 and the drill string 12 can be controlled in response to operator inputs by a surface control system 20.

The bottom hole assembly 11 can also include a measurement while drilling (MWD) tool 300 (see FIG. 1). The MWD tool 300 is suspended within the drill collar 14, up-hole of the system 10. The MWD tool 300 can include a mud-pulse telemetry system 321 (see FIGS. 1 and 17). The system 321 comprises a controller 322, a pulser 323, a pressure pulsation sensor 324, and a flow switch, or switching device 326. The system 321, as discussed below, can facilitate communication between the bottom hole assembly 11 and the surface.

Figure 17:
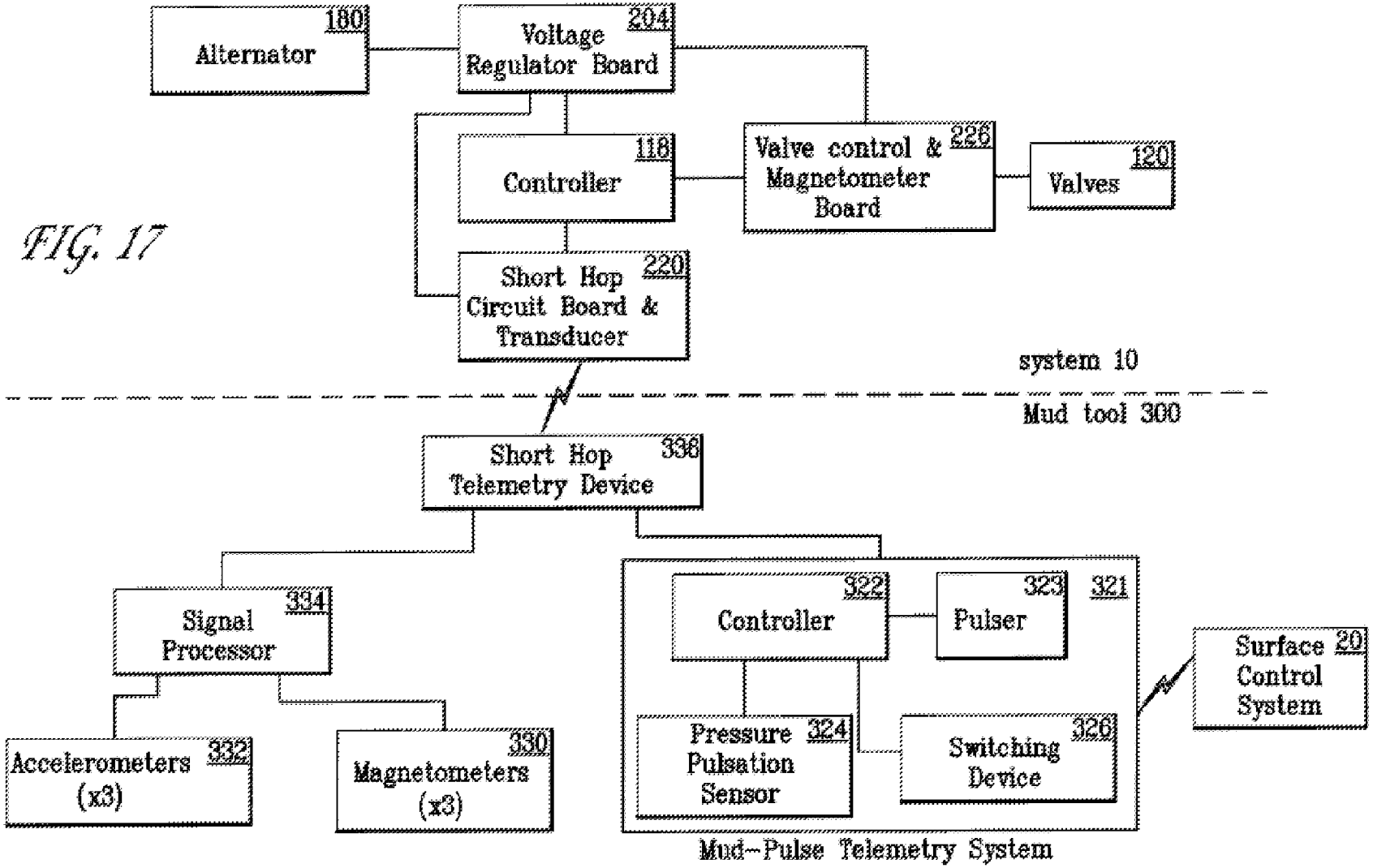
FIG. 17 is a block diagram depicting various electrical components of the rotary steerable motor system shown in FIGS. 1-16.

The MWD tool 30 can also include three magnetometers 330 for measuring azimuth about three orthogonal axes, three accelerometers 332 for measuring inclination about the three orthogonal axes, and a signal processor 334 (see FIG. 17). The signal processor 334 can process the measurements obtained from the magnetometers 330 and the accelerometers 332 to determine the angular orientation of a fixed reference point on the circumference of the drill string 12 in relation to a reference point on the bore 17. (The reference point is typically north in a vertical well, or the high side of the bore in an inclined well.) This orientation is typically referred to as "tool face," or "tool face angle."

The MWD tool 30 also includes a short-hop telemetry device 336 that facilitates communication with the system 10 by way of short-range radio telemetry.

The system 10 comprises a drilling motor 25 and a drive shaft assembly 31. The drilling motor can be a helicoidal positive-displacement pump, sometimes referred to as a Moineau-type pump. The drilling motor 25 includes a housing 26, and a stator 27 mounted on an interior surface of the housing 26 (see FIG. 3). The drilling motor 25 also includes a rotor 28 supported for rotation within the stator 27. The housing 26 is secured to the section of drill pipe immediately up-hole of the drilling motor 25 by a suitable means such as a threaded connection, so that the housing 26 rotates with the drill pipe. The housing 26 therefore forms part of the drill collar 14.

Drilling mud at bore pressure is forced between the rotor 28 and the stator 27. The stator 27 and the rotor 28 are shaped so that the movement of the drilling mud therethrough imparts rotation to the rotor 28 in relation to the stator 27. In other words, the rotor 28 extracts hydraulic energy from the flow of drilling mud, and converts the hydraulic energy into mechanical energy. As the housing 26 forms part of the drill collar 14, the rotational speed of the drill collar 14 is superimposed on the rotational speed of the rotor 28 induced by the flow of drilling mud. The drive shaft assembly 31 and the drill bit 13 are coupled to the rotor 28 so that the rotation of the rotor 28 is imparted to the drive shaft 31 and the drill bit 13.

A suitable drilling motor 25 can be obtained, for example, from Bico Drilling Tools, Inc., of Houston, Tex. It should be noted that the use of a Moineau-type pump as the drilling motor 25 is disclosed for exemplary purposes only. Other types of pumps and motors, including pumps driven by an electric motor, can be used as the drilling motor 25 in alternative embodiments.

Figure 3:
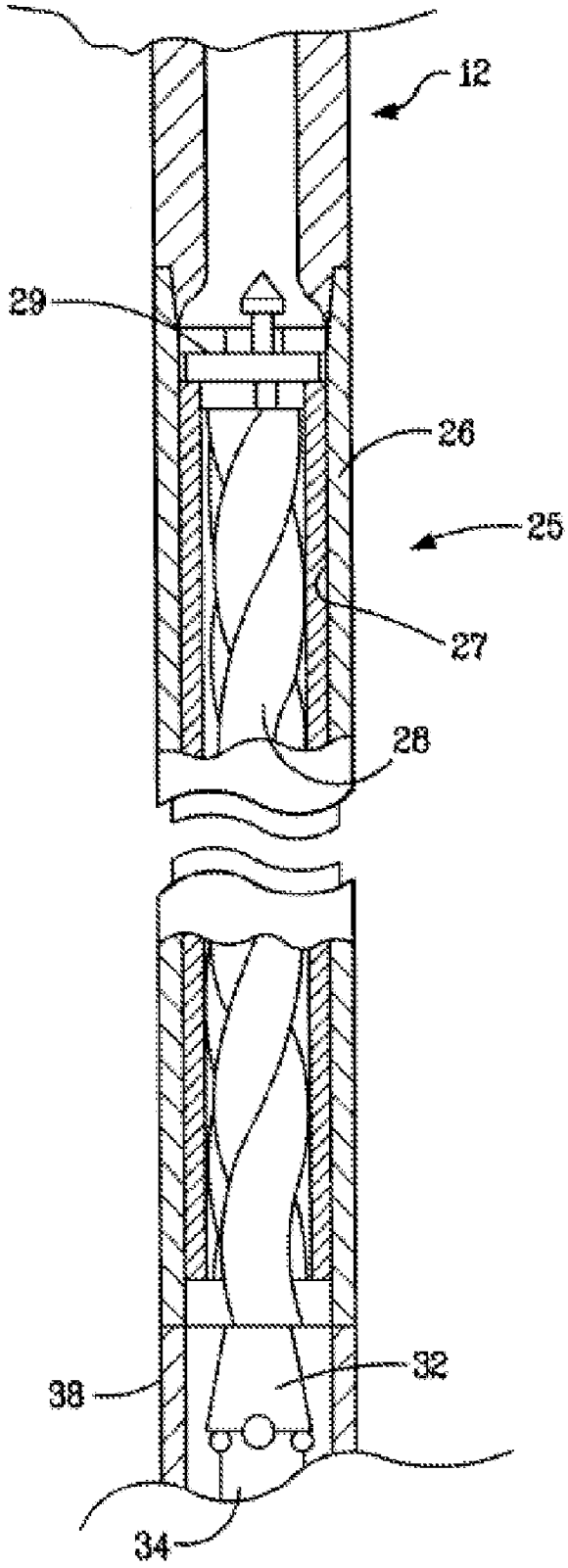
FIG. 3 is a magnified cross-sectional view of the area designated "B" in FIG. 2, taken through the line "A-A"
Figure 4:
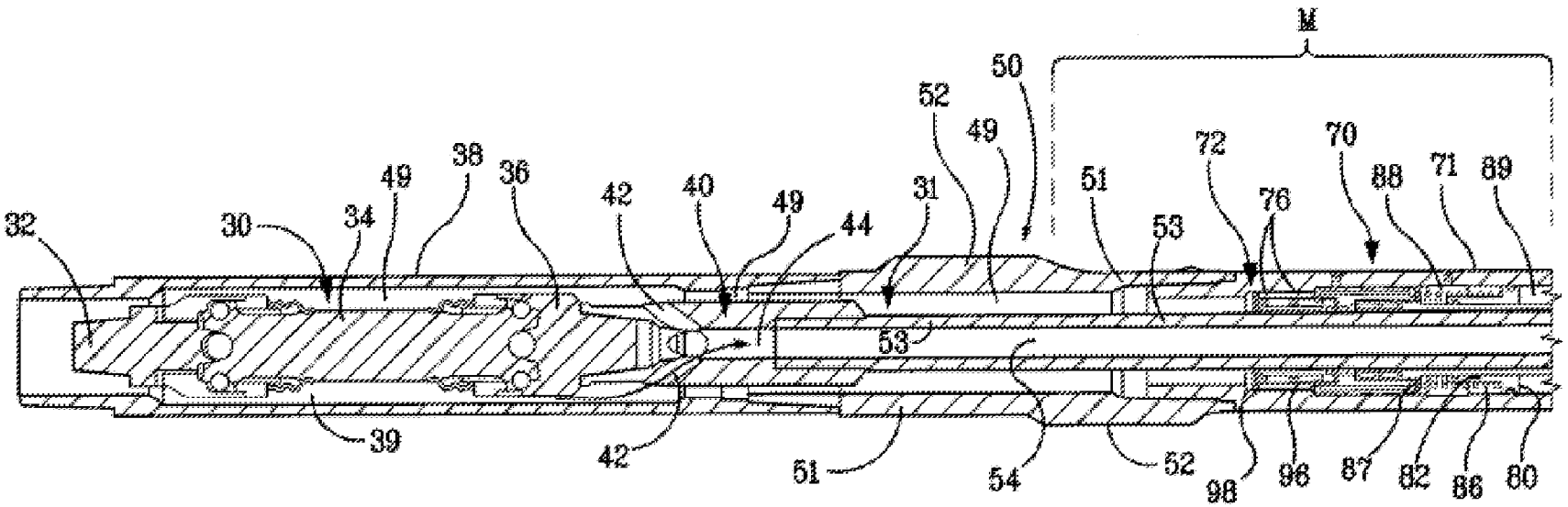
FIG. 4 is a magnified cross-sectional view of the area designated "C" in FIG. 2, taken through the line "A-A"

As shown in FIGS. 3 and 4, the system 10 also comprises a flexible coupling 30 that connects the up-hole end of the drive-shaft assembly 31 to the rotor 28 of the drilling motor. The downhole end of the drive-shaft assembly 31 (shown best in FIGS. 6 and 8) is connector to the drill bit 13. The flexible coupling 30 and the drive-shaft assembly 31 transfer the rotational motion of the rotor 28 of the drilling motor 25 to the drill bit 13.

The flexible coupling 30 comprises a first universal joint 32, a rigid shaft 34, and a second universal joint 36 (see FIGS. 3 and 4). The flexible coupling 30 is positioned within a housing 38. The housing 38 is secured to the housing 26 of the drilling motor 10 by a suitable means such as a threaded connection, so that the housing 38 rotates with the housing 26. The housing 38 thus forms part of the drill collar 14.

The first universal joint 32 is secured to the rotor 28 of the drilling motor 25 by a suitable means such as a threaded connection, so that the first universal joint rotates with the rotor 28. The first universal joint 32 is coupled to the shaft 34 so that the rotor 28 can pivot in relation to the shaft 34.

The drive shaft assembly 31 includes a diverter 40 (see FIG. 4). The diverter 40 forms the up-hole end of the drive shaft assembly 31. The second universal joint 36 is secured to the diverter 40 by a suitable means such as a threaded connection, so that the diverter 40 rotates with the second universal joint 36. The second universal joint 36 is coupled to the shaft 34 so that the second universal joint 36 and the diverter 40 can pivot in relation to the shaft 34.

The flexible coupling 30 transfers rotational motion between the rotor 28 of the drilling motor 25 and the diverter 40. The flexible coupling 30 acts as a constant-velocity joint that can facilitate rotation of the rotor 28 and the diverter 40 when the rotational axes of the rotor 28 and the diverter 40 are misaligned.

The housing 38 and the flexible coupling 30 define a passage 39 (see FIG. 4). The passage 39 receives the drilling mud exiting the drilling motor 25 at bore pressure, and facilitates the flow of drilling mud past the flexible coupling 30.

The diverter 40 has four passages 42 defined therein (see FIG. 4; only two of the passages 42 are visible in FIG. 4). Each passage 42 is angled, so that the passages 42 extend inward, toward the centerline of the diverter 40. An up-hole end of each passage 42 adjoins the passage 39. The down-hole end of each passage 42 adjoins a centrally located passage 44 formed in the diverter 40. The passages 42, 44 facilitate the flow of drilling mud through the diverter 40. In particular, a portion of the drilling mud flowing past the flexible coupling 30 is diverted into the passage 44. The remaining drilling mud, at bore pressure, fills an internal volume 49 defined, in part, by an inner surface of the housing 38, and an outer surface of the diverter 40.

Figure 2:
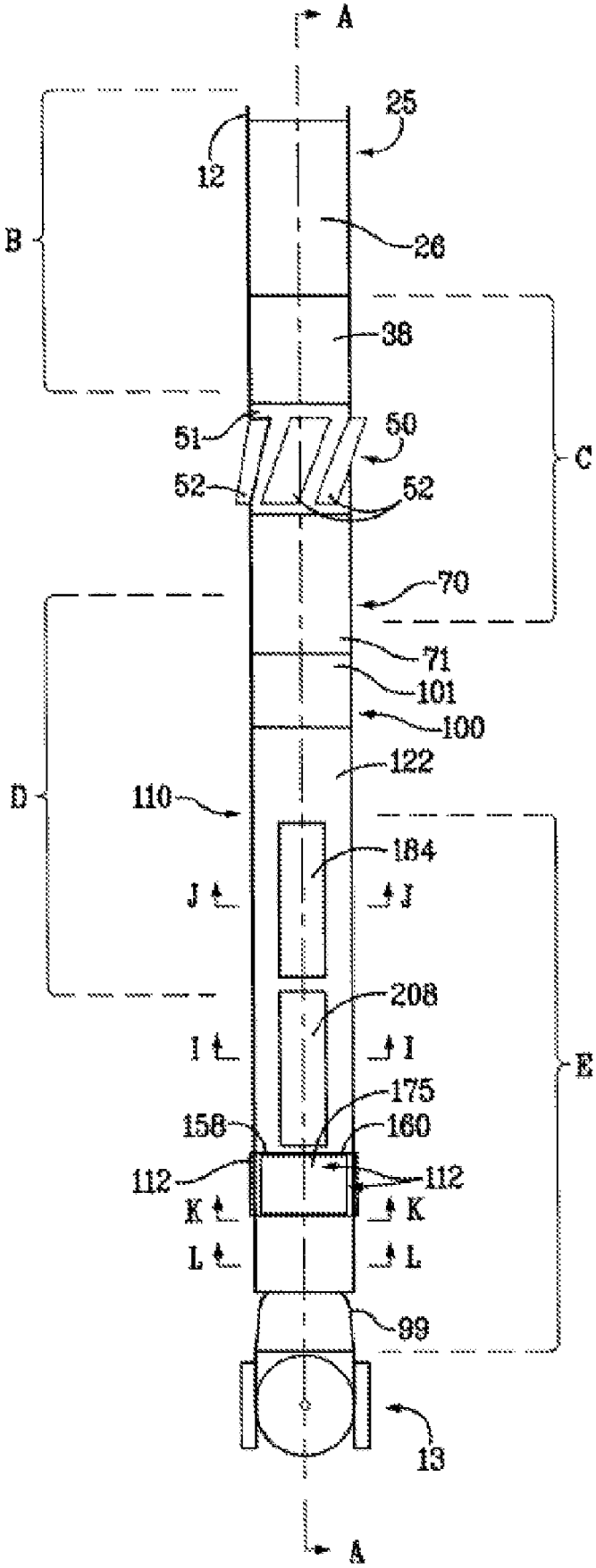
FIG. 2 is a side view the rotary steerable motor system shown in FIG. 1.

The system 10 also comprises a stabilizer 50 (see FIGS. 2 and 4). The stabilizer 50 includes a body 51, and three blades 52 that project outward from the body 51. An up-hole end of the body 51 is secured to the housing 38 by a suitable means such as a threaded connection, so that the stabilizer 50 rotates with the housing 38. The stabilizer 50 thus forms part of the drill collar 14.

The blades 52 preferably are arranged in a helical pattern. The height of the blades 52, i.e., the distance by which the blades 52 project from the body 51, is selected so that the maximum diameter of the stabilizer 50 is slightly smaller than the diameter of the bore 17. Contact between the blades 52 and the surface of the bore 17 helps to center the system 10 within the bore 17. Alternative embodiments of the stabilizer 50 can include more, or less than three of the blades 52.

The drive shaft assembly 31 also includes an upper drive shaft 53. The upper drive shaft 53 is secured to the diverter 40 by a suitable means such as a threaded connection, so that the upper drive shaft 53 rotates with the diverter 40. The upper drive shaft 53 extends through the stabilizer 50. An outer surface of the upper drive shaft 53, and an inner surface of the stabilizer 50 further define the internal volume 49.

The upper drive shaft 53 has a centrally-located passage 54 formed therein. The passage 54 adjoins the passage 44 of the diverter 40. The passage 54 receives the drilling mud from the passage 44, and permits the drilling mud to pass down-hole through the upper drive shaft 53.

The system 10 also comprises a compensation and upper seal bearing pack assembly 70 (see FIGS. 2, 4, 4A, and 5). The assembly 70 comprises a housing 71. The housing 71 is secured to the body 51 of the stabilizer 50 by a suitable means such as a threaded connection, so that the housing 71 rotates with the stabilizer 50. The upper drive shaft 53 extends through the assembly 70.

Figure 4A:
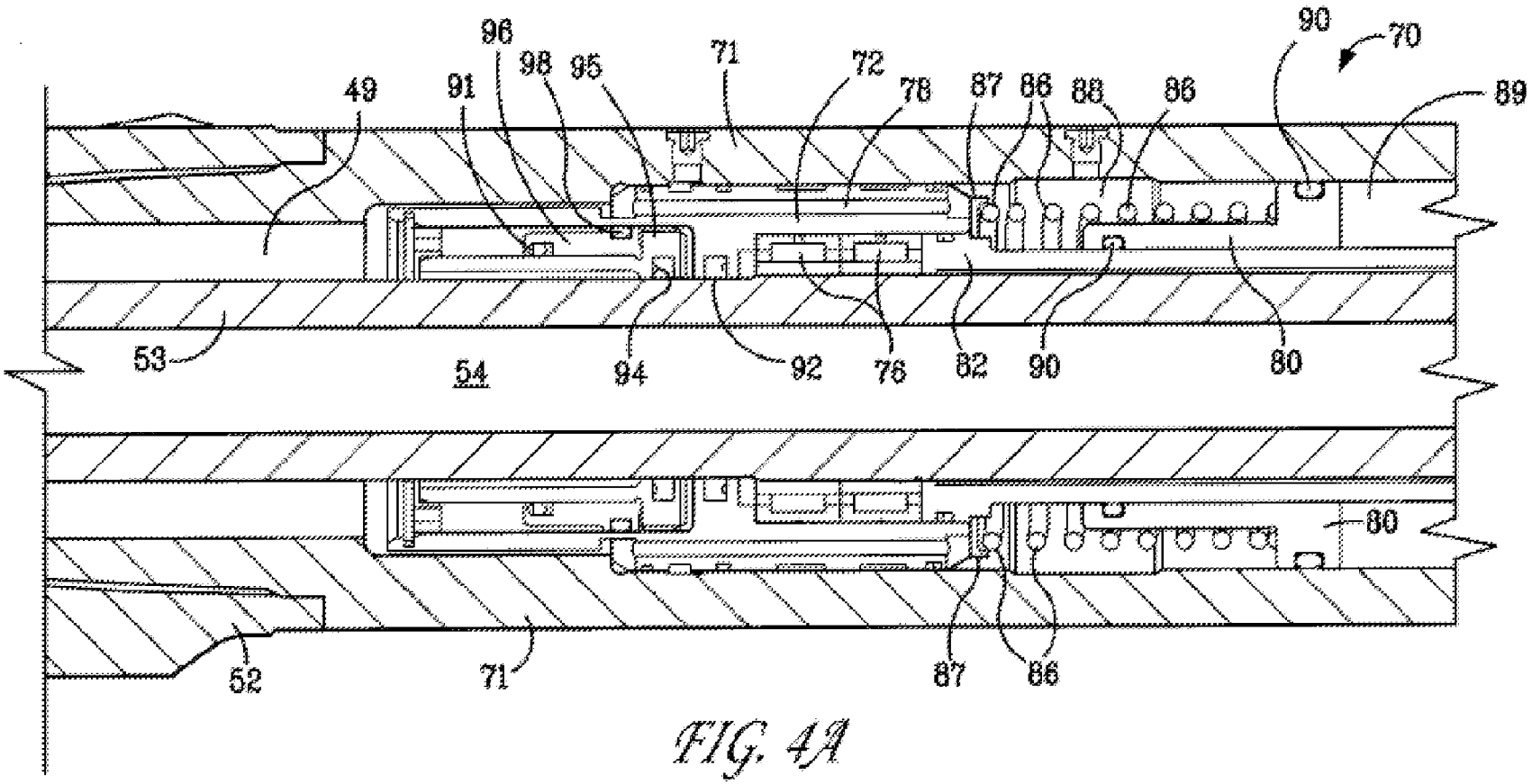
FIG. 4A is a magnified cross-sectional view of the area designated "M" in FIG. 4.

The assembly 70 also comprises a bearing support 72 positioned within the housing 71 (see FIG. 4A). The bearing support 72 is secured to the housing 71 by a suitable means such as fasteners. Two needle roller bearings 76 are mounted on the bearing support 72. The bearings 76 substantially center the upper drive shaft 53 within the housing 71, while facilitating rotation of the upper drive shaft 53 in relation to the housing 71.

The bearing support 72 has a plurality of circumferentially-spaced, axially-extending passages 78 formed therein. The passages 78 facilitate the flow of drilling mud through the bearing support 72. The drilling mud reaches the passages 78 by way of an annulus formed between the up-hole end of the bearing support 72, and an inner circumference of the housing 71.

The assembly 70 also comprises a piston 80, and a piston shaft 82. An up-hole end of the piston shaft 82 is positioned within the bearing support 72. A down-hole end of the piston shaft 82 is supported by a mounting ring 84 secured to an inner circumference of the housing 71 (see FIG. 5).

The piston 80 is disposed around the piston shaft 82, so that the piston 80 can translate in the axial direction in relation to the piston shaft 82. The assembly 70 also comprises a spring 86 positioned around the piston shaft 82. The spring 86 contacts an up-hole end of the piston 80, and a spring retainer 87 disposed around the piston shaft 82 (see FIG. 4A). The spring retainer 87 abuts the bearing support 72 and the piston shaft 82. The spring 86 biases the piston 80 in the down-hole direction.

The housing 71, the bearing support 72, the piston shaft 82, and the up-hole end of the piston 80 define an internal volume 88. The volume 88 receives drilling mud, at bore pressure, from the volume 49 by way of the passages 78 formed in the bearing support 72. The piston 80 defines the down-hole end of the internal volume 88. The up-hole face of the piston 80 therefore is exposed to drilling mud at annulus pressure.

Figure 5:
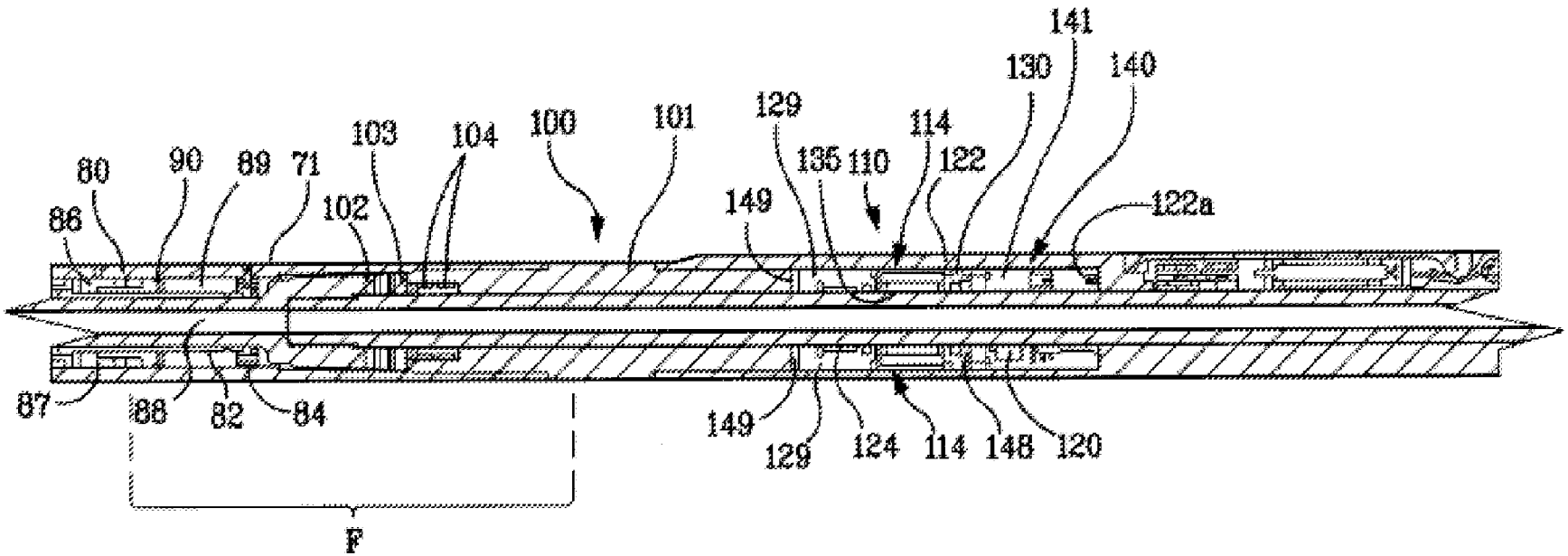
FIG. 5 is a magnified cross-sectional view of the area designated "D" in FIG. 2, taken through the line "A-A"

The housing 71, the piston shaft 83, the upper drive shaft 53, and the down-hole end of the piston 80 define an internal volume 89 down hole of the piston 80 (see FIGS. 4A and 5). The volume 89 is filled with oil, and forms part of a first hydraulic circuit within the system 10. The down-hole face of the piston 80 therefore is exposed to the oil in the first hydraulic circuit. O-ring seals 90 are positioned around the inner and outer circumference of the of piston 80. The O-ring seals 90 substantially isolate the volume 89 from the volume 88, and thereby reduce the potential for contamination of the oil by the drilling mud.

The oil can be a suitable high-temperature, low compressability oil such as MOBIL 624 synthetic oil. The oil, as discussed below, functions as a lubricant, a hydraulic fluid, and a oil.

The piston 80 can move axially in relation to the piston shaft 82. The piston 80 therefore can raise or lower the pressure of the oil in the volume 89, in response a pressure differential between the drilling mud and the oil. In particular, the combined force of the drilling mud and the spring 86 on the piston 80 urges the piston 80 in the down-hole direction, thereby increasing the pressure of the oil, until the force of the oil on the piston 80 is approximately equal to the combined, opposing force of the drilling mud and the spring 86 on the piston 80. The additional force provided by the spring 86 helps to ensure that the pressure of the oil in the first hydraulic circuit is higher than the pressure of the drilling mud, thereby reducing the potential for infiltration of the drilling mud into the oil.

The pressure of the drilling mud can vary with the depth of the system 10 within the bore 17. The piston 80 causes the pressure of the oil in the first hydraulic circuit to vary proportionately with changes in the pressure of the drilling mud, so that the pressure of the oil remains higher than the pressure of the drilling mud. In other words, the piston 80 compensates for variations in the pressure of the drilling mud during drilling operations.

The bearings 76 are wetted by oil from the volume 88. The oil reaches the bearings 76 by way of an annulus formed between the inner circumference of the piston shaft 82, and the upper drive shaft 53. The annulus and the wetted volume around the bearings 76 form part of the first hydraulic circuit.

The assembly 70 also comprises a first and a second seal 92, 94. The first and second seals 92, 94 can be, for example, rotary shaft lip seals or rotary shaft face seals.

The first and second seals 92, 94 are positioned around the upper drive shaft 53 (see FIG. 4A). The first seal 92 is located within an annulus formed in the bearing support 72. A down-hole end of the first seal 92 is exposed to the oil used to lubricate the bearings 76, i.e., the oil in the first hydraulic circuit. An up-hole end of the first seal 92 is exposed to oil contained within a second hydraulic circuit. The first seal 92 substantially isolates the oil in the first hydraulic circuit from the oil in the second hydraulic circuit.

The oil in the second hydraulic circuit, while isolated from the oil in the first hydraulic circuit, can be the same type of oil used in the first hydraulic circuit.

The second seal 94 is located within an annulus formed in a seal housing 95. The seal housing 95 is positioned within the bearing support 72. A down-hole end of the second seal 94 is exposed to the oil in the second hydraulic circuit. An up-hole end of the second seal 94 is exposed to drilling mud. The second seal 94 substantially isolates the oil from the drilling mud.

A second piston 96 is positioned around the seal housing 95, so that the piston 96 can translate axially in relation to the seal housing 95. A down-hole face of the piston 96 is exposed to the oil in the second hydraulic circuit. An up-hole face of the piston 96 is exposed to drilling mud, at bore pressure, in the volume 49. O-ring seals 98 are positioned around the inner and outer circumference of the of piston 96. The O-ring seals 98 substantially isolate the oil from the drilling mud, and thereby reduce the potential for contamination of the oil by the drilling mud.

The pressurization of the oil in the second hydraulic circuit by the piston 96 substantially equalizes the pressure across the second seal 94. Equalizing the pressure across the second seal 94 can discourage infiltration of the drilling mud into the second hydraulic circuit, and can reduce the rate of wear of the second seal 94 resulting from by contact with the upper drive shaft 53.

The pressurization of the oil in the second hydraulic circuit by the piston 96 also substantially equalizes the pressure across the first seal 92, potentially reducing the rate of wear of the first seal 92 resulting from by contact with the upper drive shaft 53.

The drive shaft assembly 31 further comprises a lower drive shaft 99. The up-hole end of the lower drive shaft 99 is secured to the down-hole end of the upper drive shaft 53 by a suitable means such as a threaded connection, so that the lower drive shaft 99 rotates with the upper drive shaft 53. The drill bit 13 is mounted on a bit box 105 that forms the down-hole end of the lower drive shaft 99. Drilling torque therefore is transferred from the drilling motor 25 to the drill bit 13 by way of the diverter 40, the upper drive shaft 53, and the lower drive shaft 99.

The lower drive shaft 99 has a centrally-located passage 106 formed therein. The passage 106 adjoins the passage 54 of the upper drive shaft 53. The passage 106 receives the drilling mud from the passage 54, and directs the drilling mud to pass down-hole to the drill bit 13.

The system 10 further comprises a crossover subassembly 100 (see FIG. 5). The crossover subassembly 100 includes a housing 101. An up-hole end of the housing 101 is secured to the housing 71 of the assembly 70 by a suitable means such as a threaded connection, so that the housing 101 rotates with the housing 71. The housing 101 thus forms part of the drill collar 14. The lower drive shaft 99 extends through the housing 101.

Figure 7:
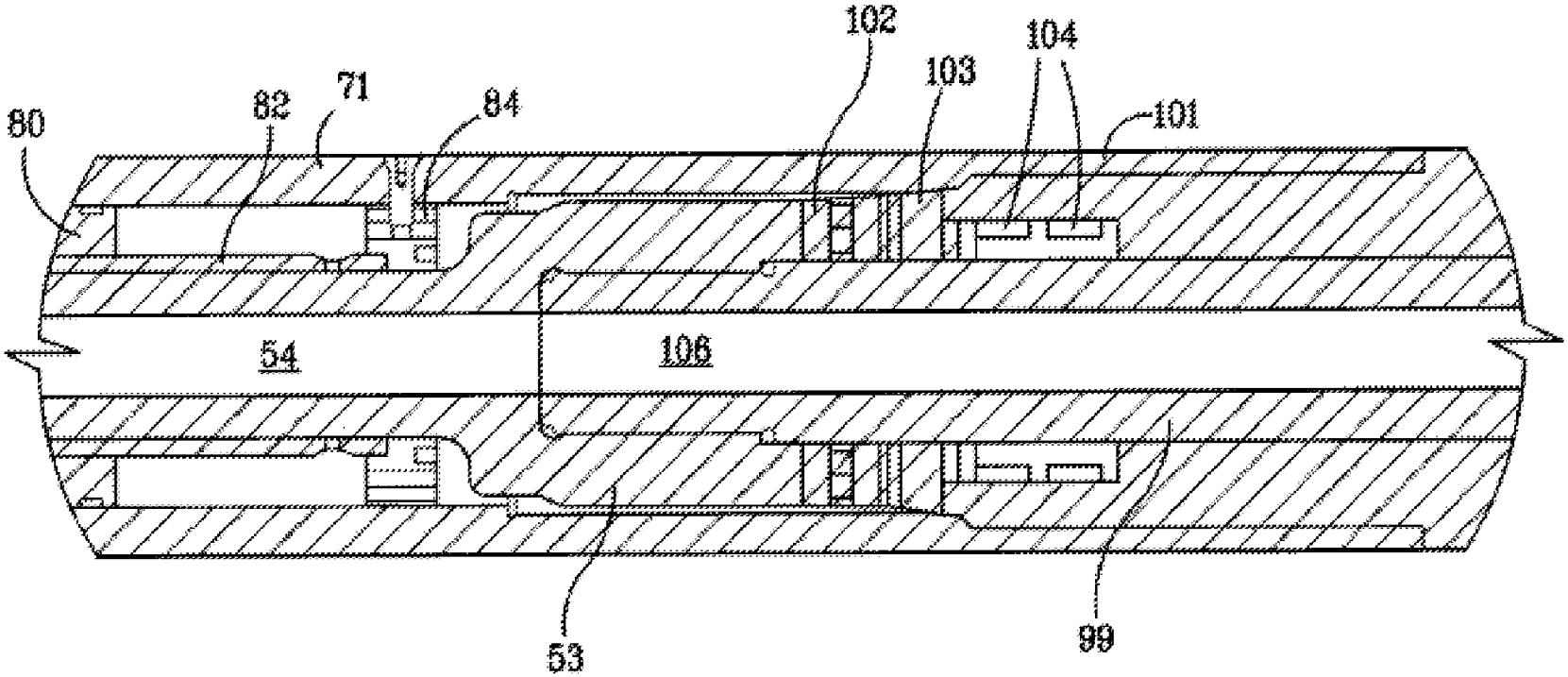
FIG. 7 is a magnified cross-sectional view of the area designated "F" in FIG. 5.

The crossover subassembly 100 also comprises a thrust bearing 102, and a spacer 103 located immediately down-hole of the bearing 102 (see FIGS. 5 and 7). The bearing 102 and the spacer 103 are positioned around the lower drive shaft 99, between the down-hole end of the upper drive shaft 53 and the up-hole end of the housing 101.

The bearing 102 supports the lower drive shaft 99 and the drill bit 13 by way of the spacer 103 and the housing 101, as the drill string 12 is raised and lowered within the bore 17. The bearing 102 and the spacer 103 are sized so that an axial clearance exists between the bearing 102 and the spacer 103 during drilling operations. The bearing 102 therefore is unloaded as the drill string 12 is urged in the down-hole direction during drilling operations. The manner in which axial loads are transmitted during through the system 10 drilling operations is discussed below.

The crossover subassembly 100 includes two needle roller bearings 104 positioned around the lower drive shaft 99, between the spacer 103 and the housing 101. The bearings 104 substantially center the lower drive shaft 99 within the housing 101, while facilitating rotation of the lower drive shaft 99 in relation to the housing 101. The bearings 104 are lubricated by the oil in the first hydraulic circuit. The oil reaches the bearing 104 by way of various passages and clearances within the crossover subassembly 100 and other components of the system 10.

The system 10 further includes a guidance module 110 (see FIGS. 2 and 5-15). and 4). The guidance module 110 can guide the drill bit 13 in a direction coinciding with a desired direction of the bore 17 at a particular location in the earth formation 16.

The guidance module 110 comprises three actuating arms 112 that extend and retract on a selective basis to push the drill bit 13 in a desired direction (see FIGS. 3, 1, and 12-15). The actuating arms 112 are actuated by oil contained in a third hydraulic circuit within the system 10. The guidance module 110 includes a hydraulic pump 114 that increases the pressure of the oil to a level suitable for forcing the actuating arms 112 against the surface of the bore 17.

The extension and retraction of the actuating arms 112 is controlled by a microprocessor-based controller 118, and three electro-hydraulic valves 120 that direct the oil toward a respective one of the actuating arms 112 in response to commands from the controller 118 (see FIGS. 9, 10A-10E, 16, and 17).

The guidance module 110 also includes a housing 122. The housing 122 is secured to the housing 101 of the crossover assembly 100 by a suitable means such as a threaded connection, so that the housing 122 rotates with the housing 101. The housing 122 thus forms part of the drill collar 14.

The guidance module 110 includes two needle roller bearings 124 positioned around the lower drive shaft 99 (see FIG. 5). The bearings 124 substantially center the lower drive shaft 99 within the housing 122, while facilitating rotation of the lower drive shaft 99 in relation to the housing 122. The bearings 122 are lubricated by the oil in the first hydraulic circuit. The oil reaches the bearing 122 by way of various passages and clearances within the guidance module 110 and the crossover subassembly 100.

The pump 114 is positioned immediately down hole of the bearing housing 126. The pump 114 preferably is a hydraulic vane pump. The pump 114 comprises a stator 127, and a rotor 128 disposed concentrically within the stator 127 (see FIGS. 11A and 11B). The pump 114 also comprises a bearing seal housing 129 secured to a down-hole end of the stator 127, and a manifold 130 secured to an up-hole end of the stator 127. The bearings 124 are disposed concentrically within the bearing seal housing 129.

The manifold 130 has three inlet ports 131*a*, and three outlet ports 131*b* formed therein. Oil from within the third hydraulic circuit enters the hydraulic pump 114 by way of the inlet ports 131*a*. The oil in the third hydraulic circuit, while isolated from the oil in the first and second hydraulic circuits, can be the same type of oil used in the first and second hydraulic circuits. (Other types of fluids can be used in the third hydraulic circuit, in the alternative.)

The lower drive shaft 99 extends through the pump 114 so that the housing 122, the pump 114, and the lower drive shaft 99 are substantially concentric. The stator 127, bearing seal housing 129, and manifold 130 of the pump 114 are restrained from rotating in relation to the housing 122, as discussed below.

The rotor 128 is rotated in relation to the stator 127 by the drive shaft 99, as discussed below. Spring-loaded vanes 132 are disposed in radial grooves 133 formed in the rotor 128. Three cam lobes 134 are positioned around the inner circumference of the stator 127. The cam lobes 134 contact the vanes 132 as the rotor 128 rotates within the stator 127. The shape of the cam lobes 134, in conjunction with the spring force on the vanes 132, causes the vanes 132 to retract and extend into and out of the grooves 133.

Each vane 132 moves radially outward as the vane 132 rotates past the inlet ports 131*a*, due to the shape of the cam lobes 134 and the spring force on the vane 132. This movement generates a suction force that draws oil through the inlet ports 131*a*, and into an area between the rotor 128 and the stator 127.

Figure 11A:
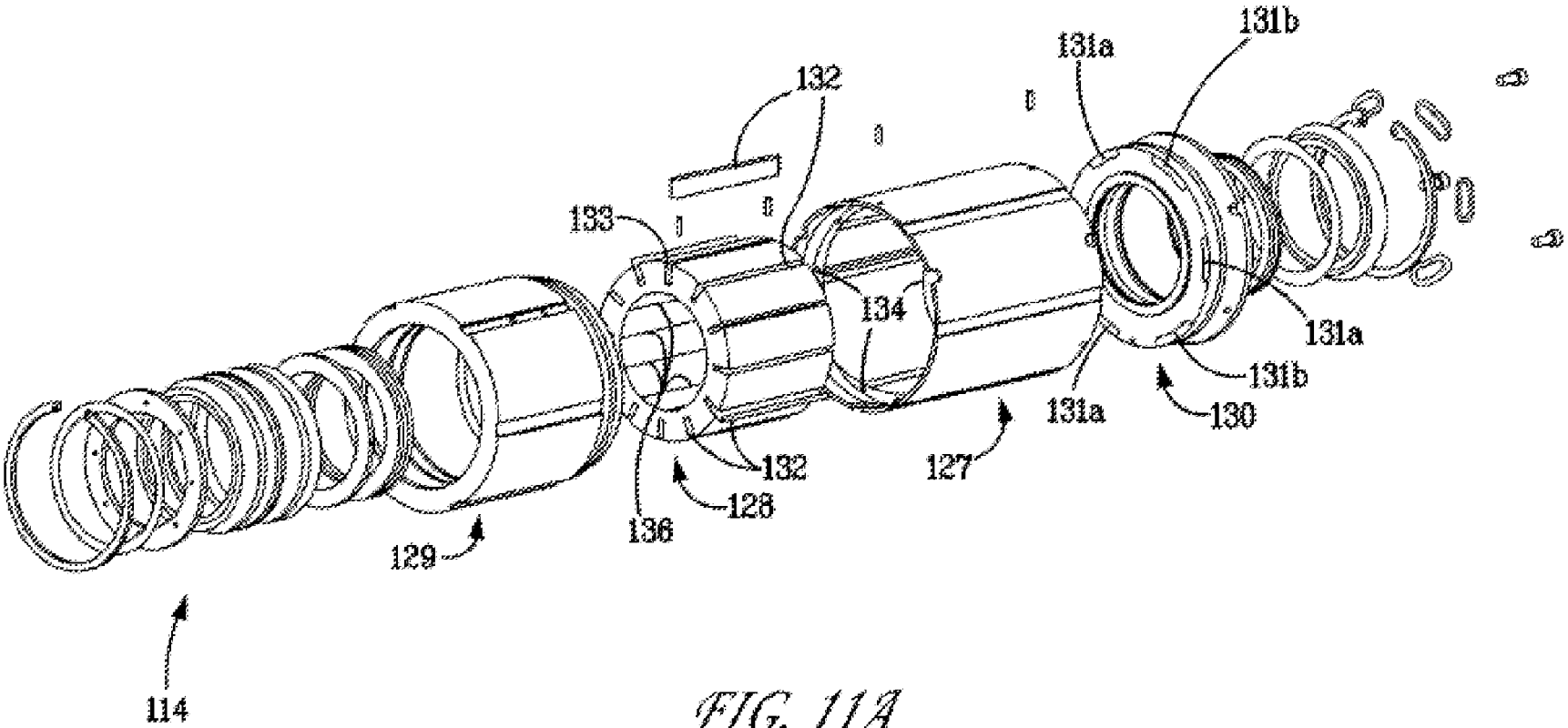
FIG. 11A is an exploded, perspective view of a hydraulic pump of the rotary steerable motor system shown in FIGS. 1-10F.
Figure 11B:
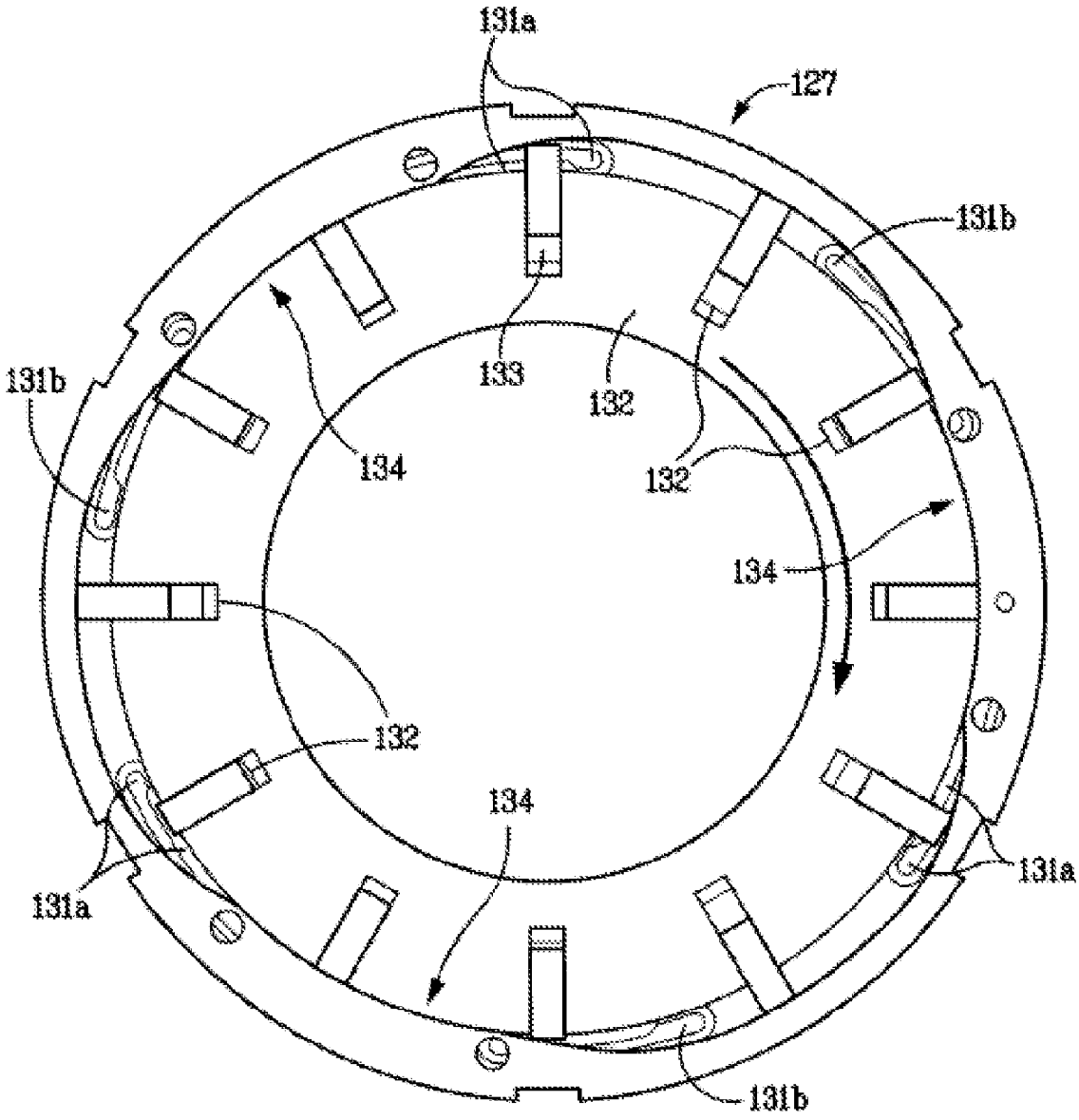
FIG. 11B is a transverse cross-sectional view of the hydraulic pump shown in FIG. 11A.

Further movement of the vane 132 sweeps the oil in the clockwise direction, toward the next cam lobe 134 and outlet port 131*b* (from the perspective of FIG. 11B). The profile of the cam lobe 134 reduces the area between the rotor 128 and the stator 127 as the oil is swept toward the outlet port 131*b*, and thereby raises the pressure of the oil. The pressurized oil is forced out of pump 114 by way of the outlet port 131*b*.

The use of a hydraulic vane pump such as the pump 114 is described for exemplary purposes only. Other types of hydraulic pumps that can tolerate the temperatures, pressures, and vibrations typically encountered in a down-hole drilling environment can be used in the alternative. For example, the pump 114 can be an axial piston pump in alternative embodiments.

The pump 114 is driven by the lower drive shaft 99. In particular, the portion of the lower drive shaft 99 located within the rotor 128 preferably has splines 135 formed around an outer circumference thereof. The spines 135 extend substantially in the axial direction. The splines 135 engage complementary splines 136 formed on the rotor 128, so that rotation of the lower drive shaft 99 in relation to the housing 122 imparts a corresponding rotation to the rotor 128 (see FIGS. 5 and 11A). The use of the axially-oriented spines 135, 136 facilitates a limited degree of relative movement between lower drive shaft 99 and the rotor 128 in the axial direction. This movement can result from factors such as differential thermal deflection, mechanical loads, etc. Permitting the rotor 128 to move in relation to the drive lower shaft 99 can reduce the potential for the pump 114 to be subject to excessive stresses resulting from its interaction with the lower drive shaft 99.

A ball bearing 148 is concentrically within on the manifold 130. The bearing 148 helps to center the lower drive shaft 99 within the pump 114, and thereby reduces the potential for the pump 114 to be damaged by excessive radial loads imposed thereon by the lower drive shaft 99. The bearing 148 is lubricated by the oil in the third hydraulic circuit.

The guidance module 110 further includes a hydraulic manifold assembly 140 located down hole of the pump 114 (see FIGS. 5 and 9-10F). The hydraulic manifold assembly 140 comprises the valves 120, a body 141, a casing 162 positioned around a portion of the body 141, and a bypass valve 144. The valves 120 and the bypass valve 144 are mounted on the body 141.

The pump 114 and hydraulic manifold assembly 140 are positioned between the housing 101 of the crossover subassembly 100, and a lip 122*a* of the housing 122. A crush ring 149 is positioned between the housing 101, and the up-hole end of the pump 114.

The crush ring 149 is sized so that the stacked length (axial dimension) of the crush ring 149, pump 114, and hydraulic manifold assembly 140 is greater than the distance between the down-hole end of the housing 101, and the lip 122*a*. The crush ring 149 deforms as the crossover subassembly 100 and the guidance module 110 are mated. The interference generated by the crush ring 149 results in axial and frictional forces between the housing 101, crush ring 149, pump 114, hydraulic manifold assembly 140, and housing 122. These forces help to secure the pump 114 and the hydraulic manifold assembly 140 to the housing 122. The pump 114 and the hydraulic manifold assembly 140 are restrained from rotating in relation to the housing 112 by pins.

The body 141 of the hydraulic manifold assembly 140 has circumferentially-extending, outwardly-facing first and second grooves 163*a*, 163*b* formed therein (see FIGS. 9, 10A, 10C, and 10E). The first groove 163*a* and the overlying portion of the casing 162 define a first annulus 143*a* in the hydraulic manifold assembly 140. The second groove 163*b* and the overlying portion of the casing 162 define a second annulus 143*a* in the hydraulic manifold assembly 140. The first and second annuli 143*a*, 143*b* form part of the third hydraulic circuit.

The first annulus 143*a* is in fluid communication with the inlet ports 131*a* of the pump 114 by way of passages 165*a* formed in the body 141 (see FIGS. 9, 10A, 10D, 10E). The first annulus 143*a* therefore holds oil at a pressure approximately equal to the inlet pressure of pump 114 during operation of the system 10.

The second annulus 143*b* is in fluid communication with the outlet ports 131*b* of the pump 114 by way of passages 165*b* formed in the body 141. The second annulus 143*b* therefore holds oil at a pressure approximately equal to the outlet (discharge) pressure of pump 114 during operation of the system 10.

Figure 9:
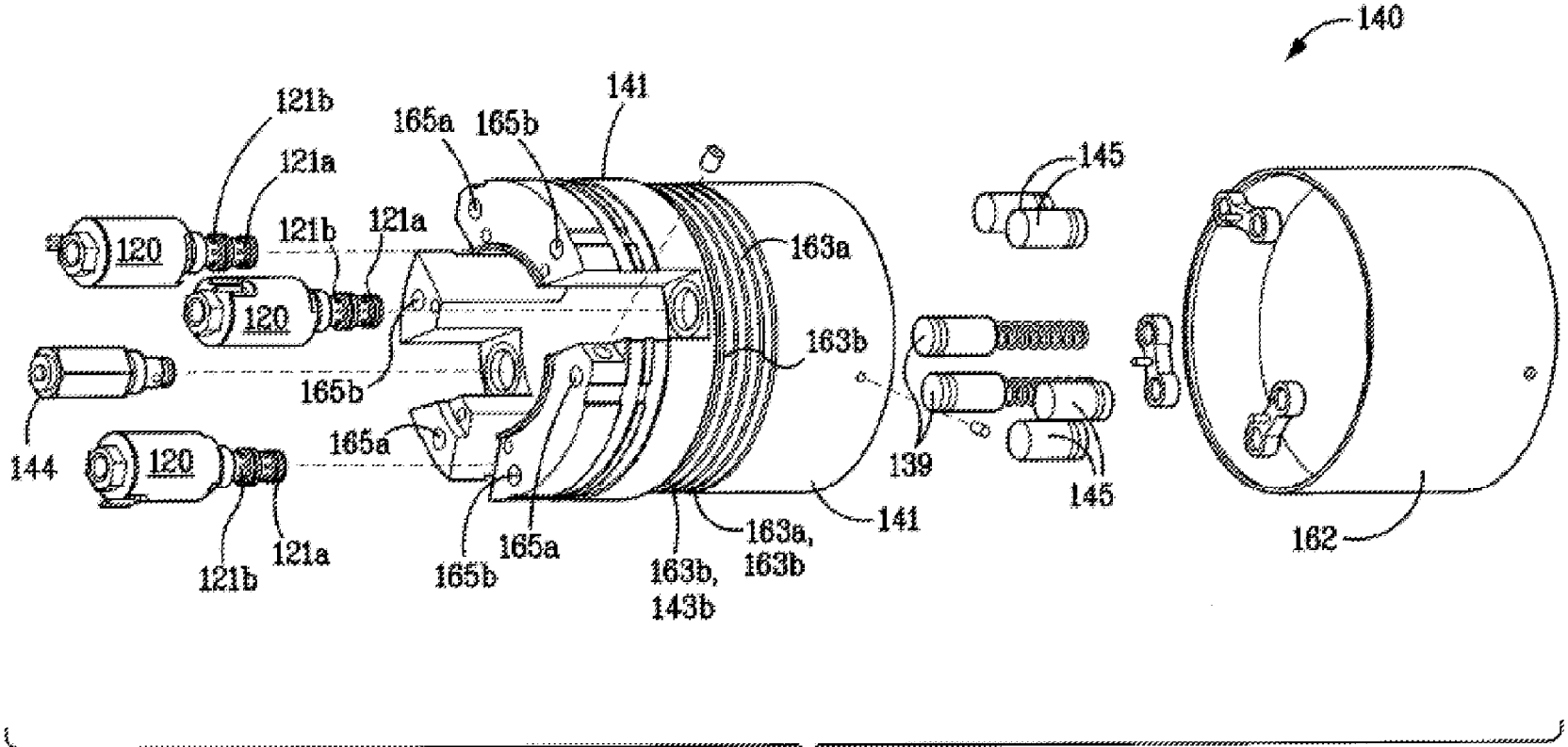
FIG. 9 is an exploded perspective view of a hydraulic manifold assembly of the rotary steerable motor system shown in FIGS. 1-8.

Each valve 120 has a first inlet 121*a* and a second inlet 121*b* (see FIG. 9). The valves 120 are mounted on the body 141 so that the first inlet 121*a* communicates with the first annulus 143*a* by way of a port 161 formed in the body 141, and the second inlet 121*b* communicates with the second annulus 143*b* by way of another port 161 (see FIG. 10C). The first inlet 120*a* therefore is exposed to oil at a pressure approximately equal to the inlet pressure of the pump 114, and the second inlet 120*b* is exposed to oil at a pressure approximately equal to the discharge pressure of the pump 114.

Figure 10A:
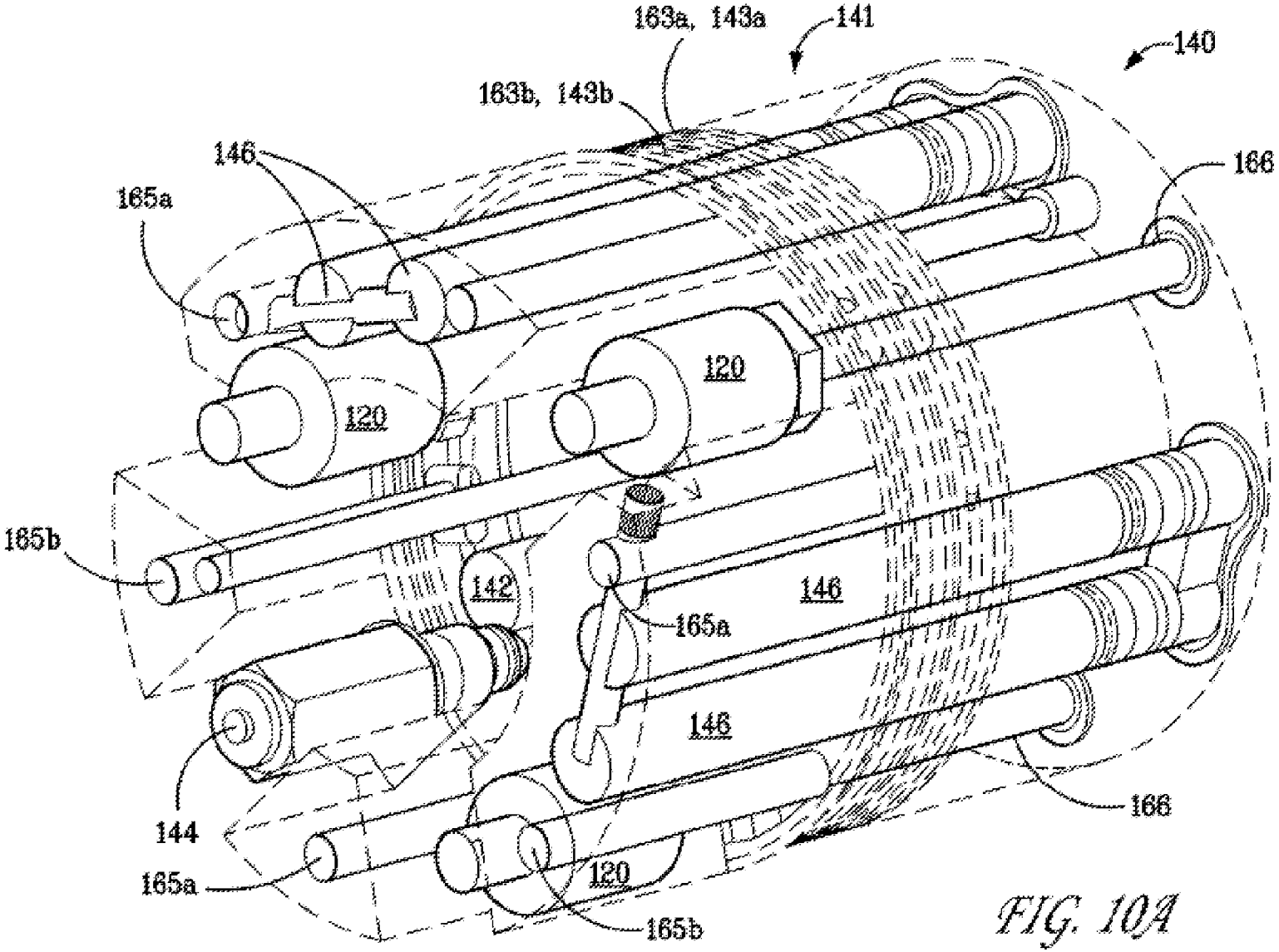
FIG. 10A is a perspective view of the hydraulic manifold assembly shown in FIG. 9, with a body of the hydraulic manifold assembly shown semi-transparently, and with a casing of the hydraulic manifold assembly removed.
Figure 10B:
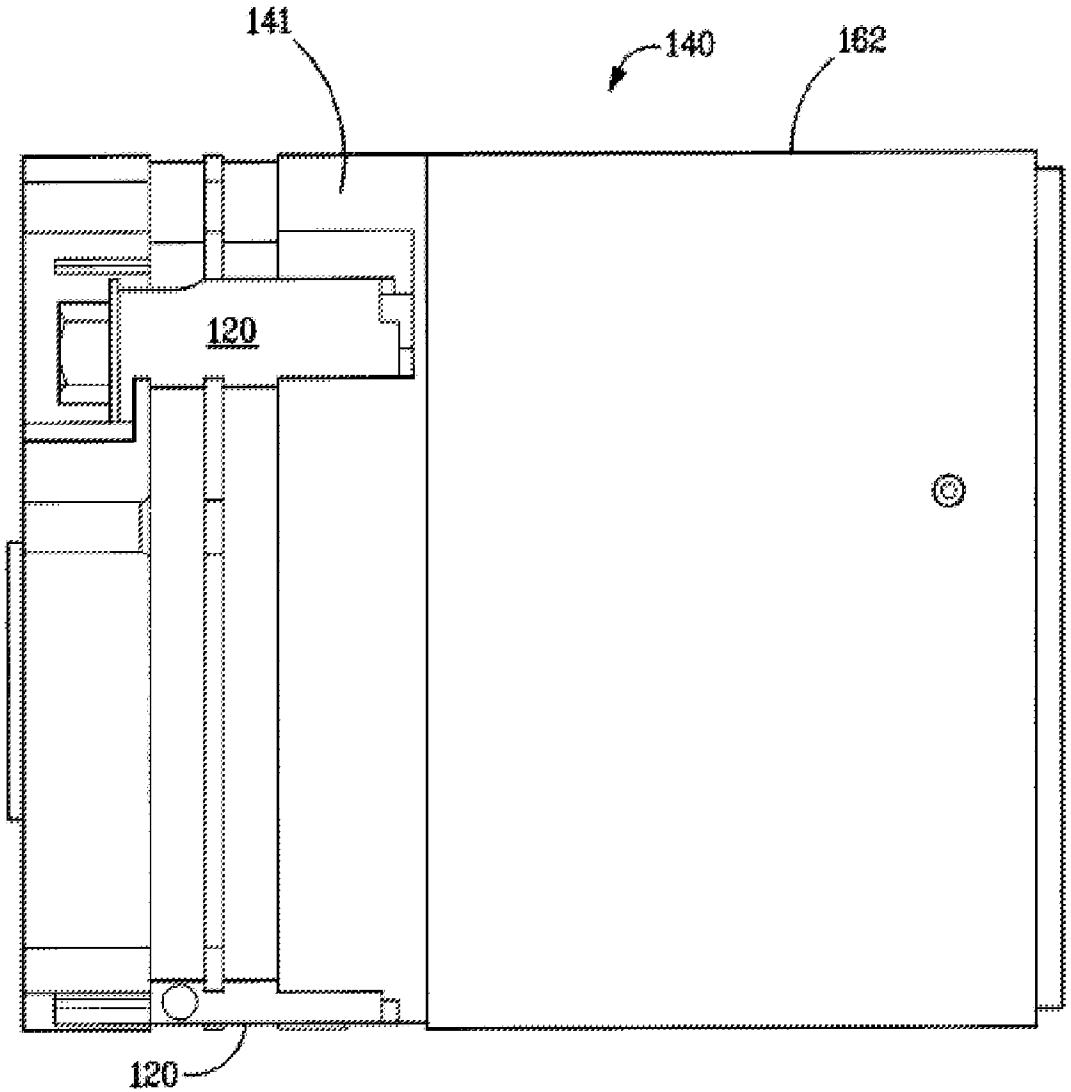
FIG. 10B is a side view of the hydraulic manifold assembly shown in FIGS. 9 and 10A.
Figure 10C:
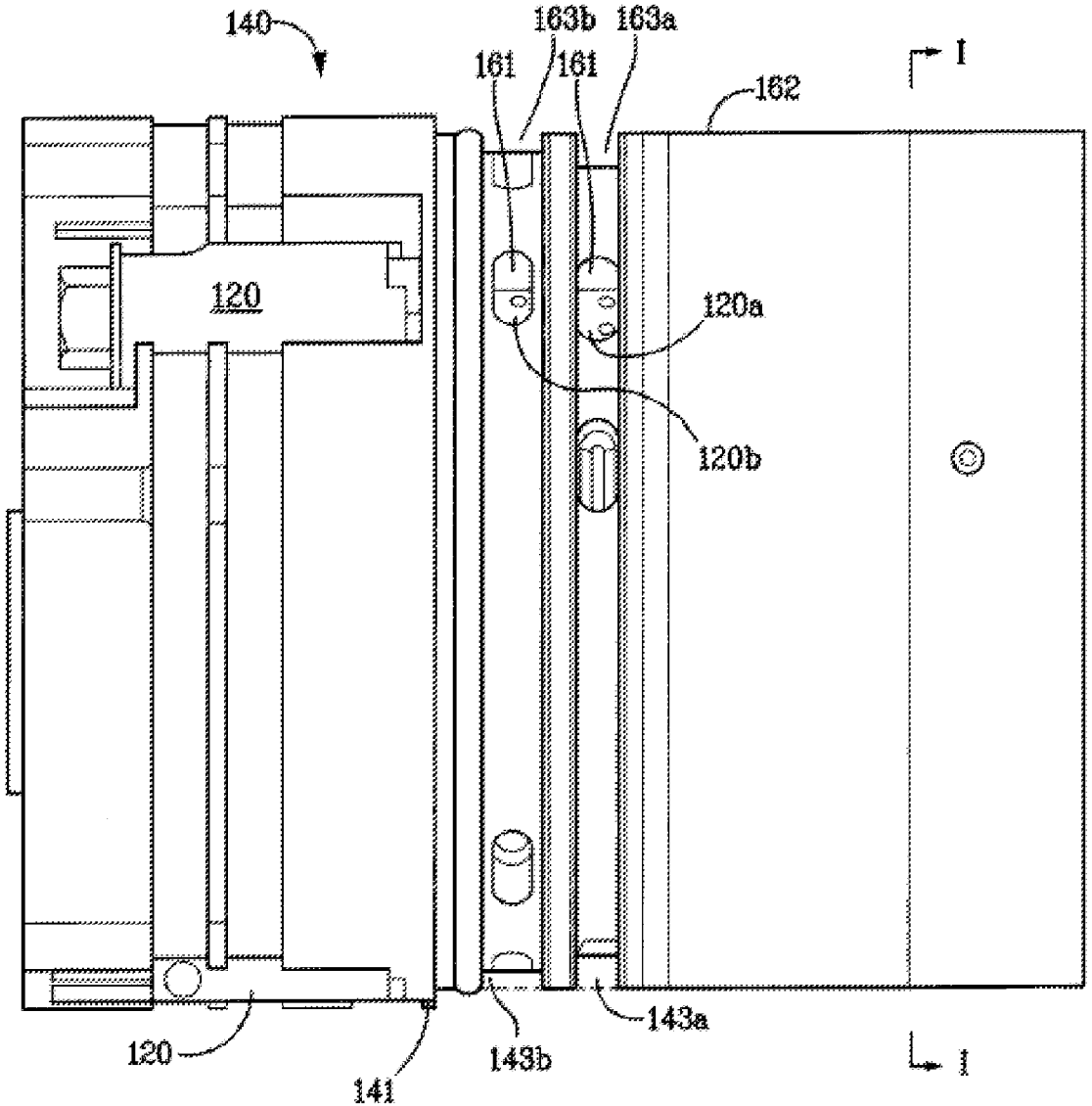
FIG. 10C is a side view of the hydraulic manifold assembly shown in FIGS. 9-10B, with the casing of the hydraulic manifold assembly removed.
Figure 10D:
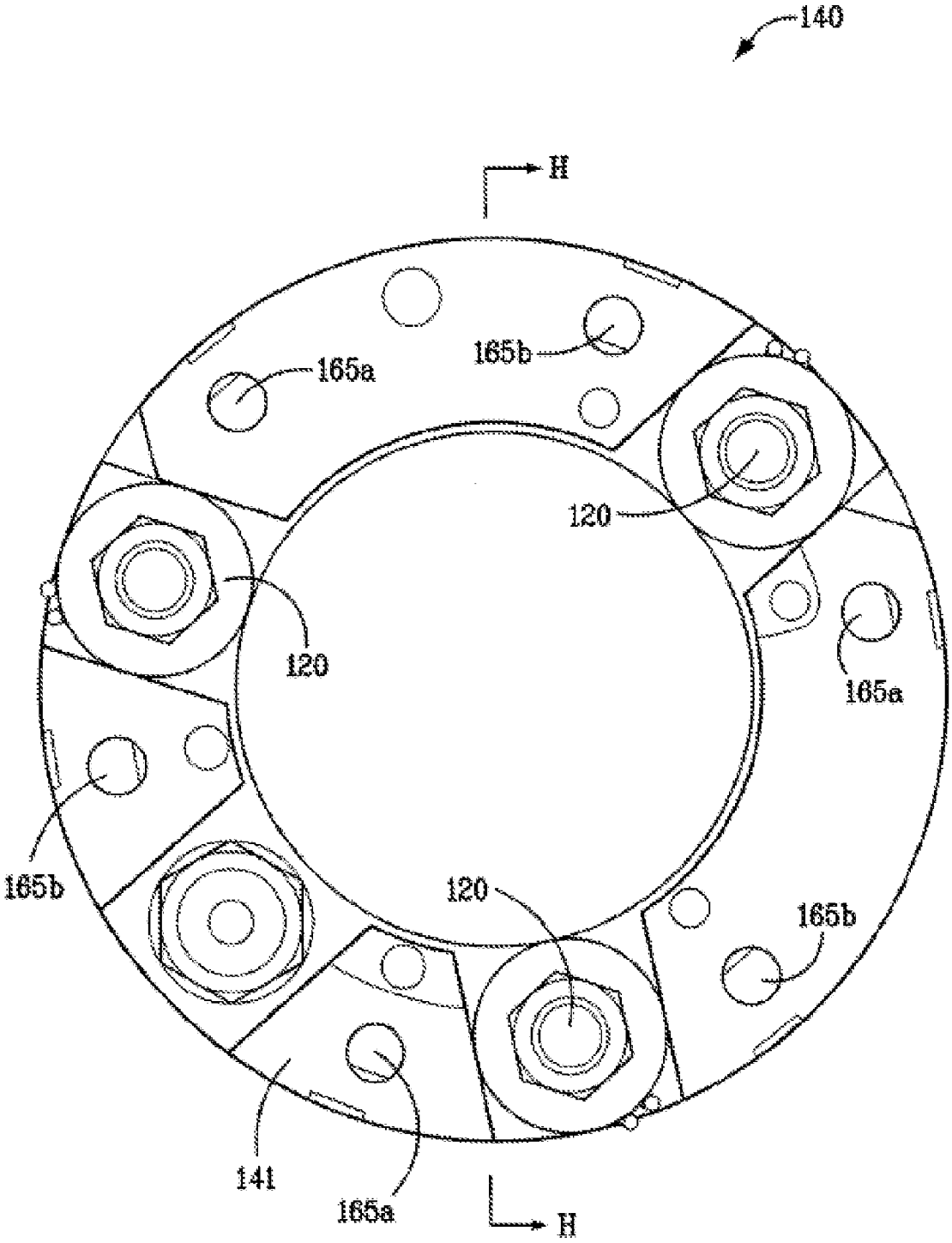
FIG. 10D is a view of the hydraulic manifold assembly shown in FIGS. 9-10C, from a perspective up-hole looking down-hole.
Figure 10E:
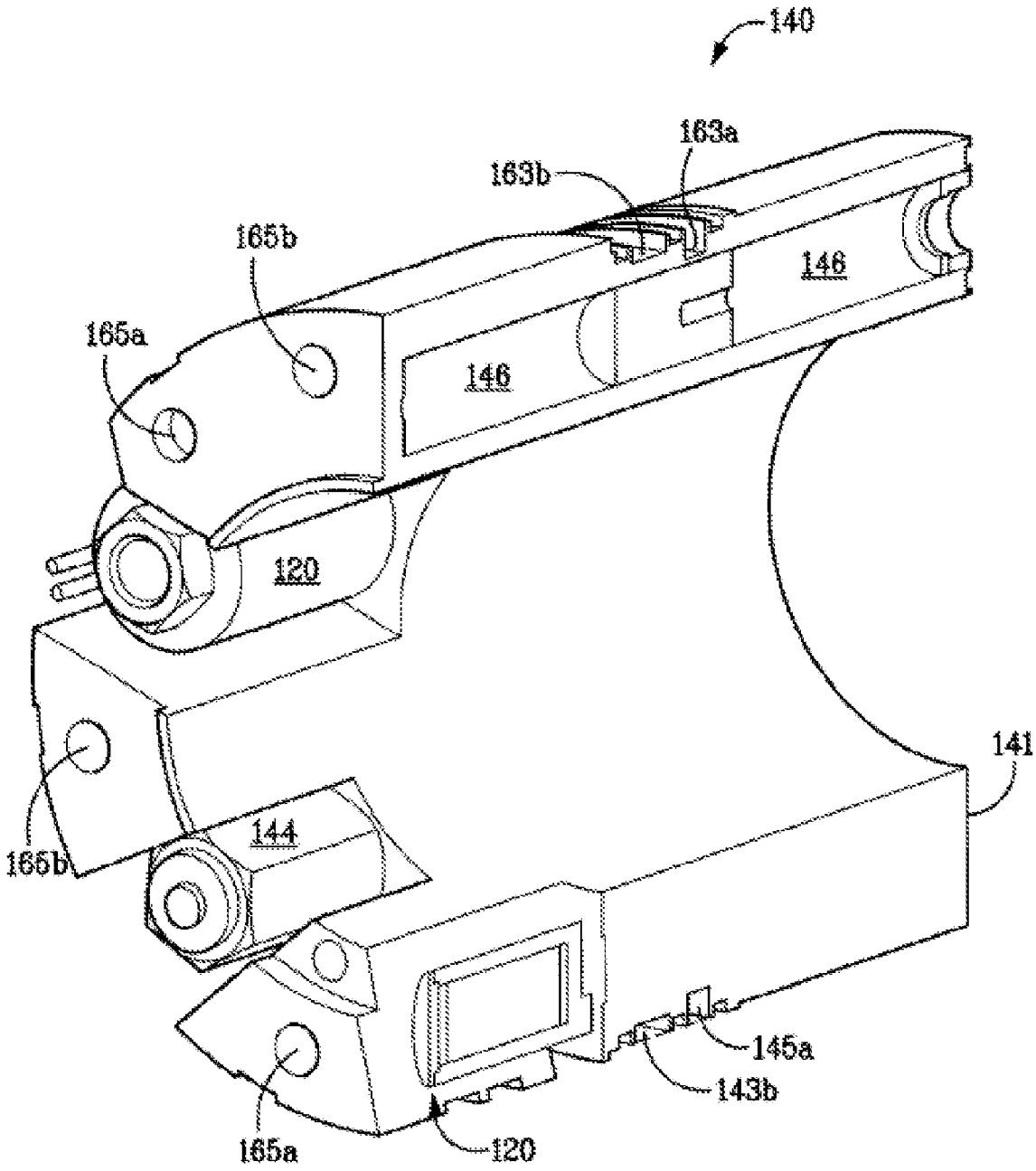
FIG. 10E is a cross-sectional perspective view of the hydraulic manifold assembly shown in FIGS. 9-10D, taken through the line "H-H" of FIG. 10D, with the casing of the hydraulic manifold assembly removed.
Figure 10F:
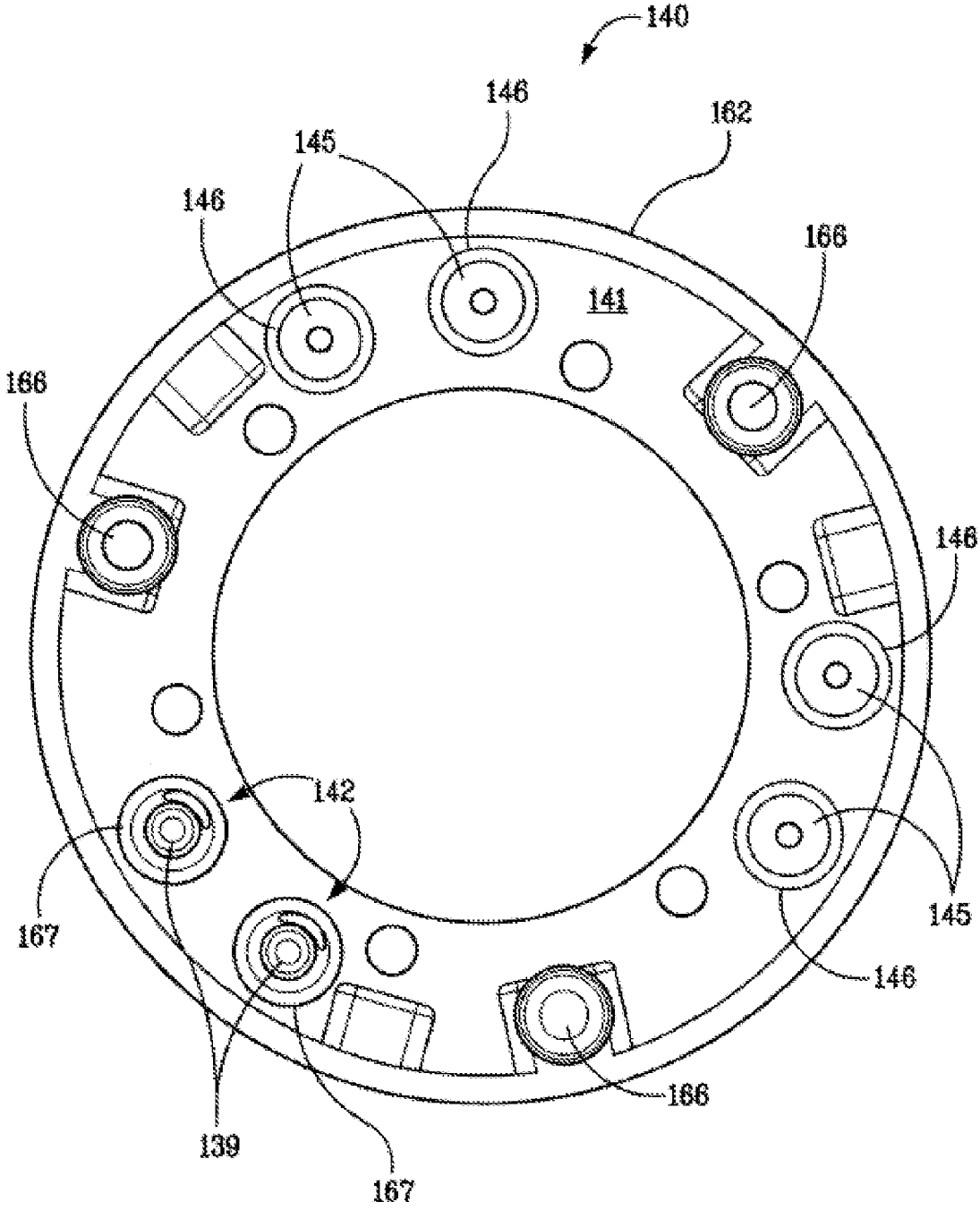
FIG. 10F is a cross-sectional perspective view of the hydraulic manifold assembly shown in FIGS. 9-10D, taken through the line "I-I" of FIG. 10C.

The body 141 has three passages 166 formed therein (see FIGS. 9 and 10F). Each passage 166 is in fluid communication with the outlet of an associated valve 120, and extends to the down-hole end of the body 141. The passages 166 further define the third hydraulic circuit.

The hydraulic manifold assembly 140 also includes four pistons 145 (see FIGS. 9, 10A, 10E, 10F). The pistons 145 are each disposed within a respective cylindrical bore 146 formed in the body 141. A down-hole end of each piston 145 is exposed to oil from the first hydraulic circuit, at approximately bore pressure. The up-hole end of each piston 145 is in fluid communication with the inlet of the pump 114. The pistons 145 therefore help to pressurize the oil at the inlet of the pump 114 to a pressure approximately equal to bore pressure.

The hydraulic manifold assembly 140 also includes two spring-loaded pistons 139 (see FIGS. 9 and 10F). The pistons 139 are each disposed within a respective cylindrical bore 167 formed in the body 141. The portion of each cylinder 167 located up-hole of the associated piston 139 is in fluid communication with the second annulus 143*b*, and therefore contains oil at a pressure approximately equal to the discharge pressure of pump 114.

A down-hole end of each piston 139 is exposed to drilling mud at bore pressure, by way of various passages formed in the body 141 and the housing 122. The combined force of the drilling mud and the associated spring against the down-hole end of the piston 139 helps to maintain the pressure in the up-hole of the piston 139 above bore pressure. Each bore 167 and its associated piston 139 thus function as an accumulator 142 that stores a reservoir of high-pressure oil in fluid communication with the second inlet 121*b* of the valves 120.

The optimal number of accumulators 142 is application-dependent, and can vary, for example, with the amount of force required to actuate the arms 112. More, or less than two accumulators 142 can be used in alternative embodiments. Other alternative embodiments can be configured without any accumulators 142.

Figure 12:
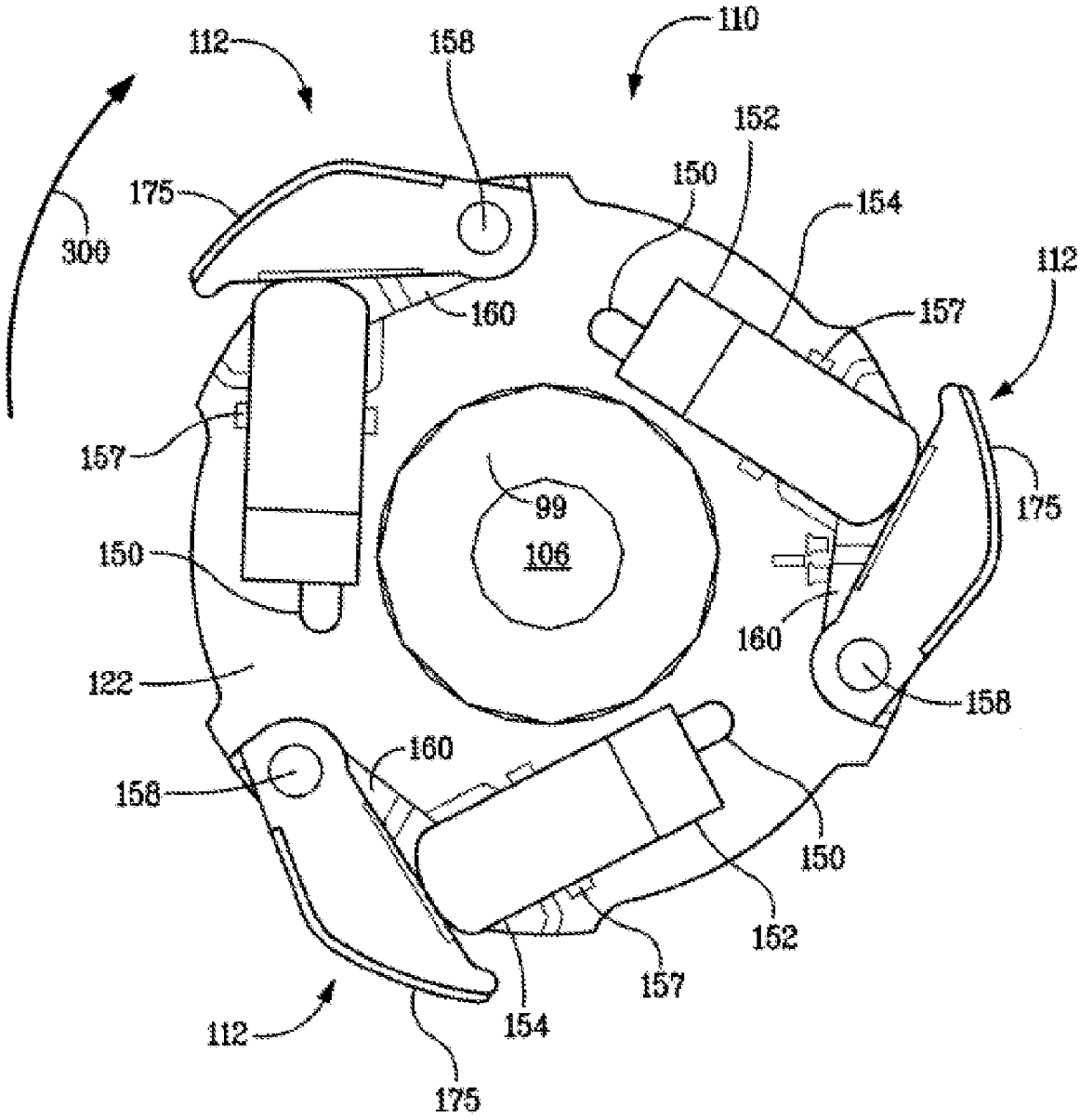
FIG. 12 is a cross sectional view of the rotary steerable motor system shown in FIGS. 1-11B, taken through the line "K-K" of FIG. 2.
Figure 13:
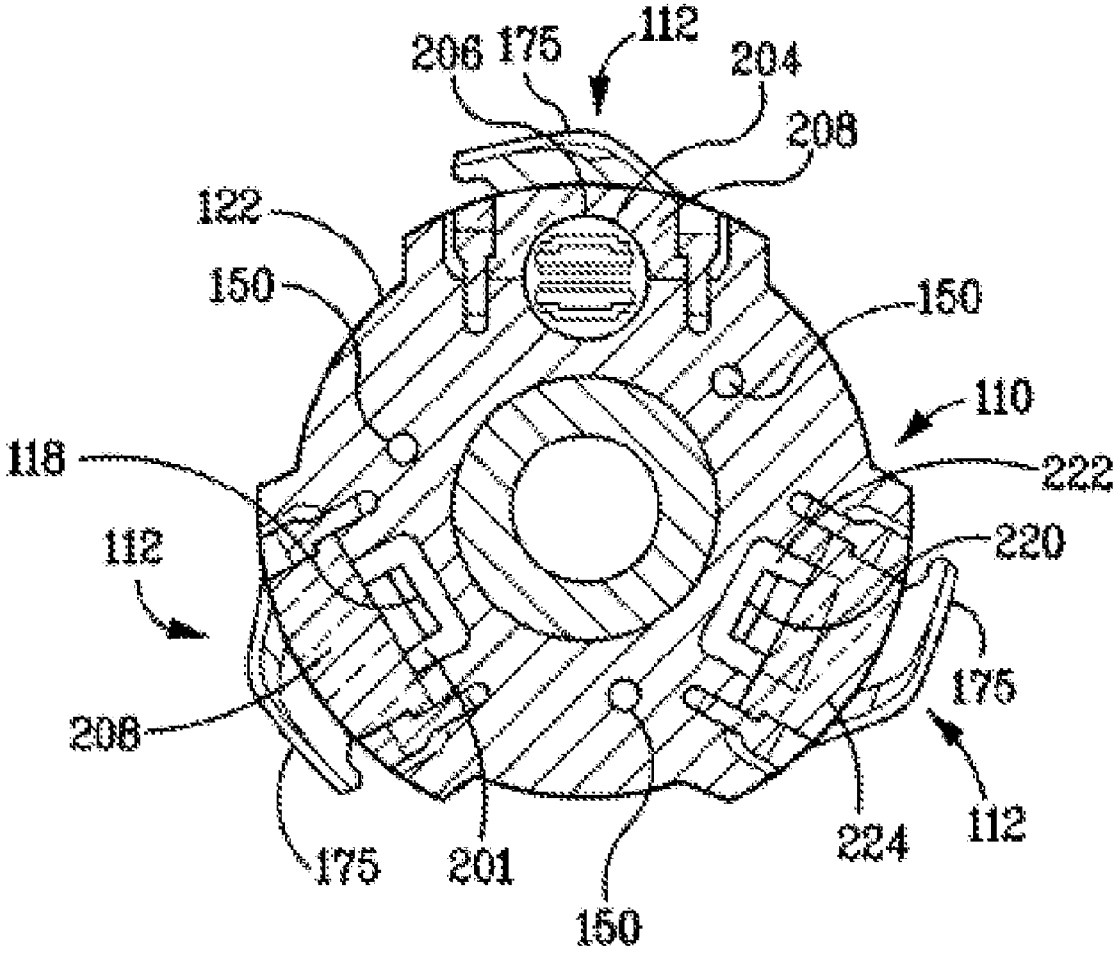
FIG. 13 is a cross sectional view of the rotary steerable motor system shown in FIGS. 1-12, taken through the line "I-I" of FIG. 2.
Figure 14:
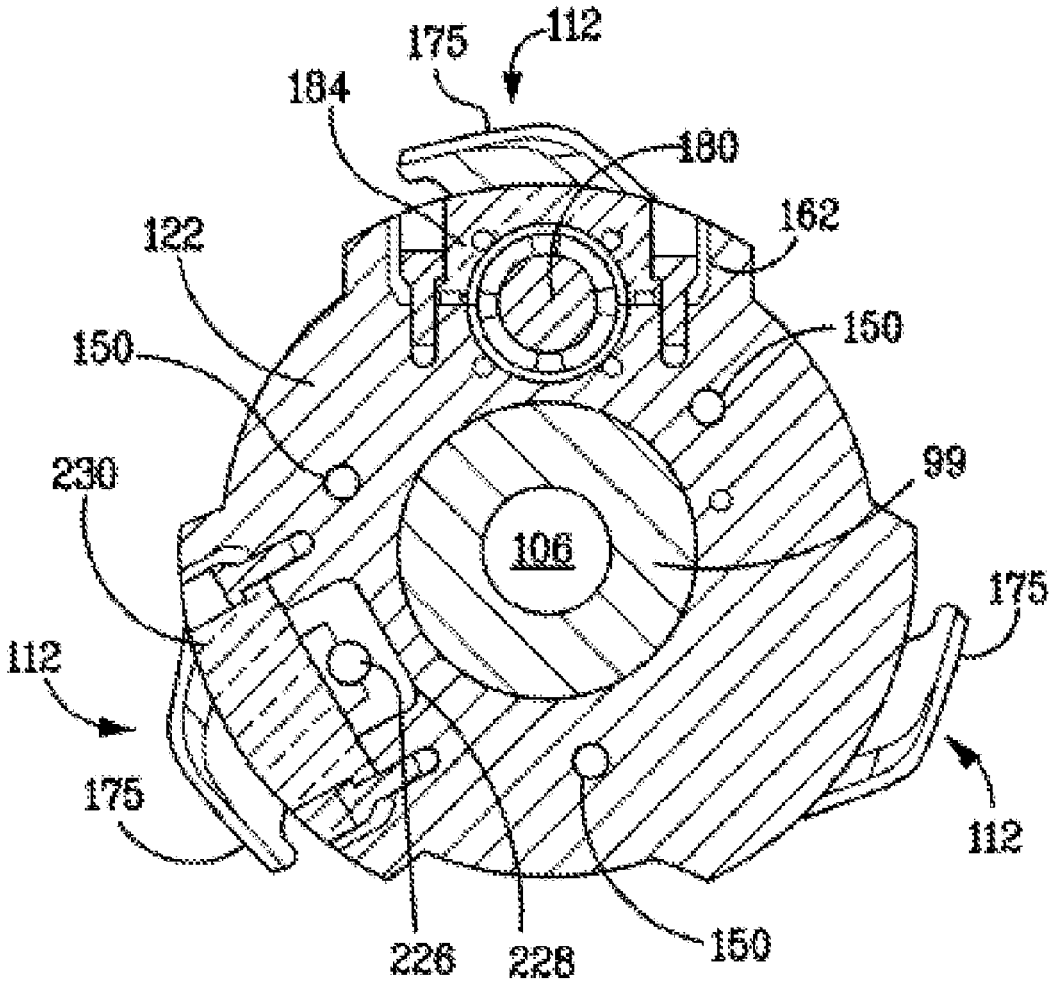
FIG. 14 is a cross sectional view of the rotary steerable motor system shown in FIGS. 1-13, taken through the line "J-J" of FIG. 2.

The housing 122 has three deep-drilled holes 150 (see FIGS. 12-14). The holes 150 form part of the third hydraulic circuit. Each hole 150 substantially aligns with, and is in fluid communication with an associated one of the passages 166 in the body 141 of the hydraulic manifold assembly 140. The holes 150 each extend down-hole, in a substantially axial direction, to a position proximate a respective one of the actuating arms 112. Each valve 120, as discussed below, selectively routes relatively high-pressure oil from the discharge of the pump 114 to an associated hole 150, in response to commands from the controller 118.

Figure 6:
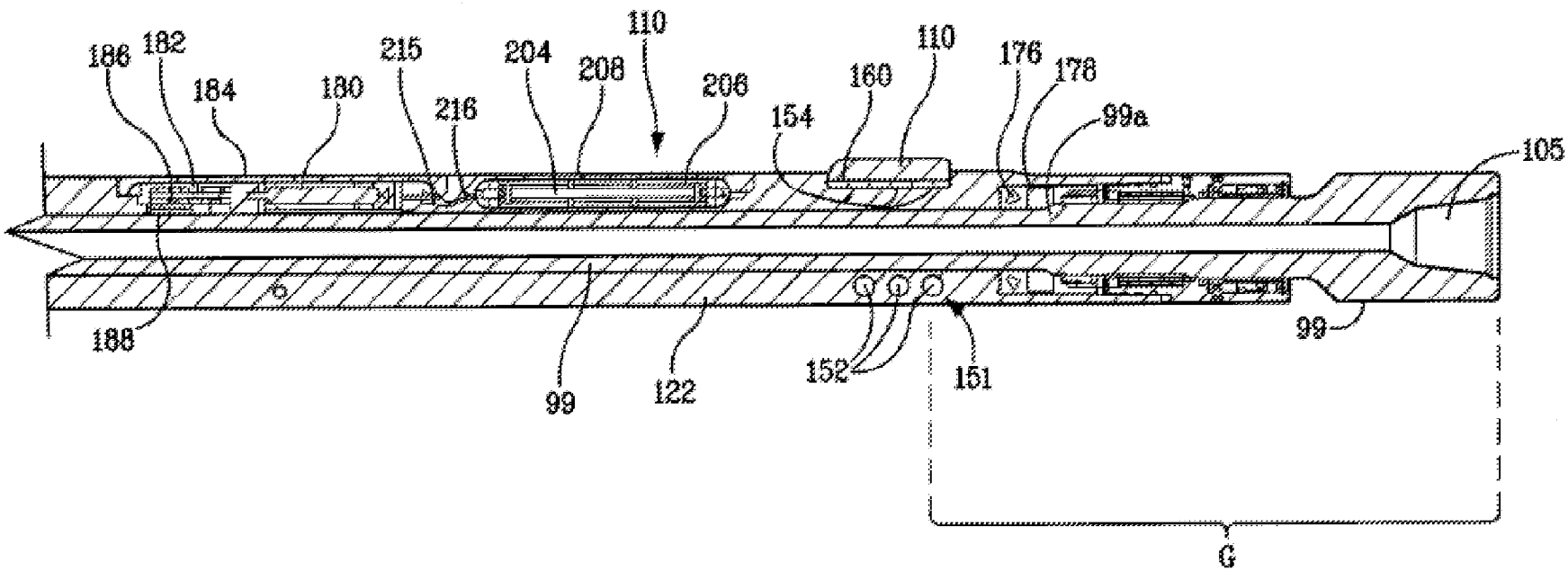
FIG. 6 is a magnified cross-sectional view of the area designated "E" in FIG. 2, taken through the line "A-A"

The housing 122 has three banks 151 of cylinders 152 formed therein (see FIGS. 6 and 12). The cylinders 152 further define the third hydraulic circuit. The cylinder banks 151 are circumferentially spaced at intervals of approximately 120 degrees. Each cylinder bank 151 includes three of the cylinders 152. The cylinder banks 151 are each positioned beneath a respective one of the actuating arms 112. Each of the holes 150 is in fluid communication with a respective cylinder bank 151. In other words, the three cylinders 152 in each cylinder bank 151 are supplied with oil from an associated hole 150.

The cylinders 152 each receive a respective piston 154. The diameter of the each piston is sized so that the piston 154 can translate in a direction substantially coincident with the central (longitudinal) axis of its associated cylinder 152. An end of each piston 154 is exposed to the oil in its associated cylinder 152. The opposite end of the piston 154 contacts the underside of an associated actuating arm 112. Seals 157 are mounted on the housing 122 (or on the pistons 154) to seal interface between the cylinder 152 and the associated piston 154, and thereby contain the high-pressure oil in the cylinder 152.

Figure 15:
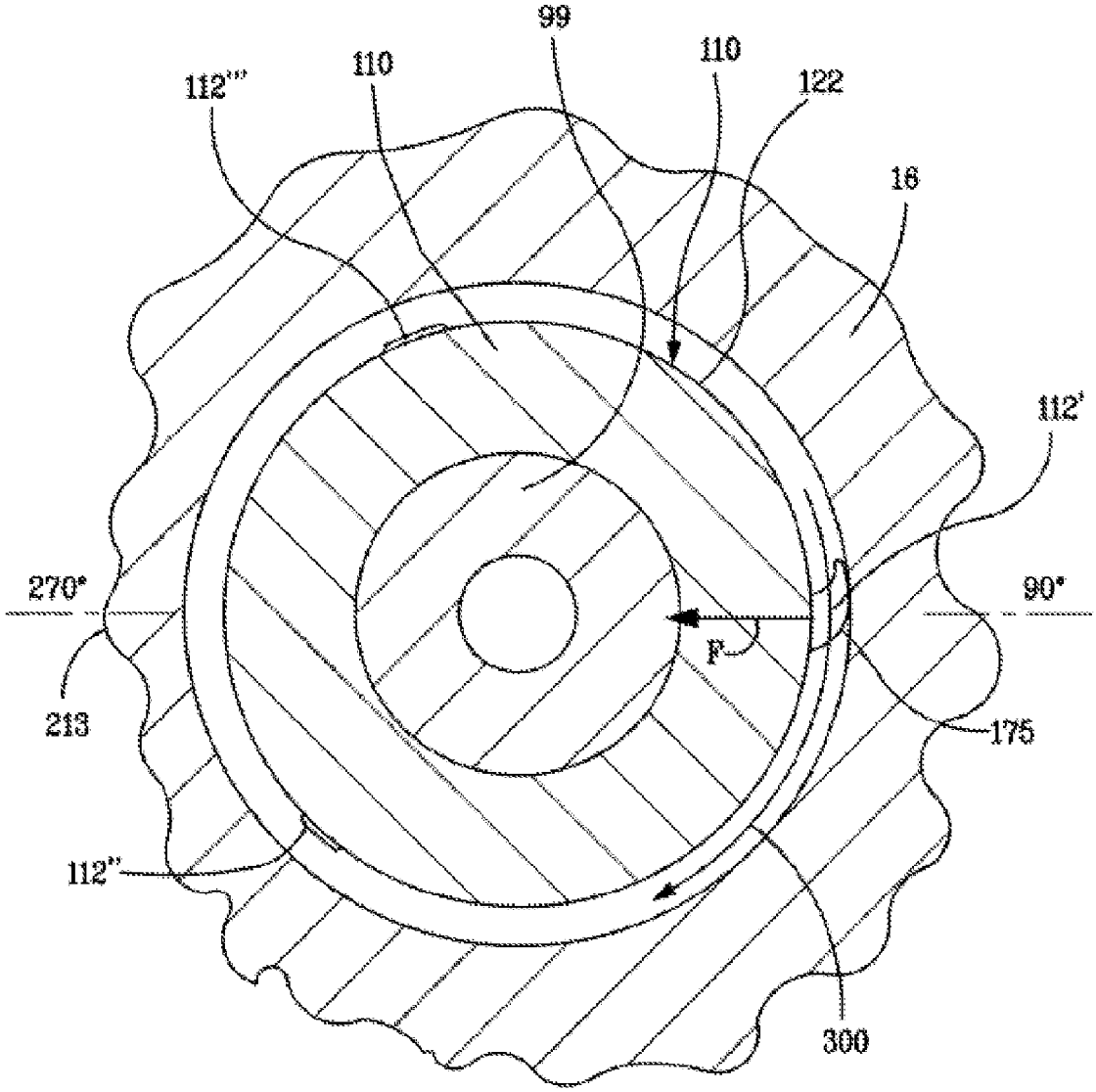
FIG. 15 is a cross sectional view of the rotary steerable motor system shown in FIGS. 1-14, taken through the line "L-L" of FIG. 2.
Figure 16:
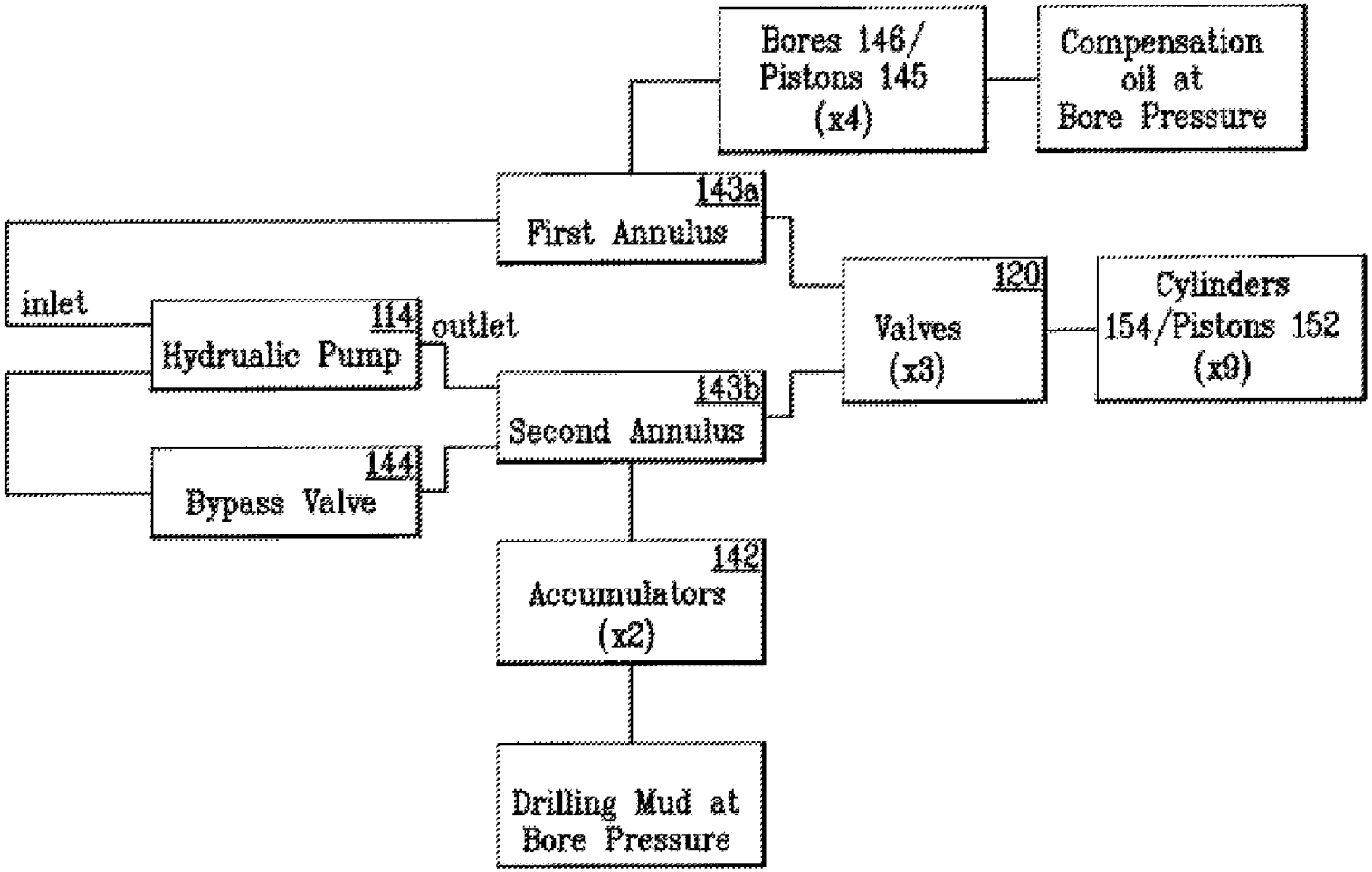
FIG. 16 is a block diagram depicting a portion of a hydraulic circuit of the rotary steerable motor system shown in FIGS. 1-15.

Each actuating arm 112 is pivotally coupled to the housing 122 by a pin 158, so that the arm 112 can pivot between an extended position (FIGS. 12-15) and a retracted position (FIGS. 2, 6, and 15). All three of the actuating arms 112 are shown in their extended positions in FIGS. 12-14, for illustrative purposes only. Only one of the arms 112 is normally extended at one time, as discussed below.

Ends of the pin 158 are received in bores formed in the housing 122, and are retained by a suitable means such as clamps. Recesses 160 are formed in the housing 122 (see FIGS. 2, 6, and 12). Each recess 160 accommodates an associated actuating arm 112, so that the outer surface of the actuating arm 112 is nearly flush with the adjacent surface of the housing 122 when the actuating arm 112 is in its retracted position. Each actuating arm 112 can be biased toward its retracted position by a torsional spring (not shown) disposed around the corresponding pin 158, to facilitate ease of handling as the system is lowered into the raised form the bore 17.

The valves 120 preferably are double-acting spool valves. The first inlet 121*a* of each valve 120 has is in fluid communication with the inlet of the pump 114 by way of the first annulus 143*a*, and the second inlet 121*b* in fluid communication with the outlet of the pump 114 by way of the second annulus 143*b*, as noted above. The outlet of each valve 120 is in fluid communication with a respective one of the holes 150, by way of the passages 166.

The valve 120 permits relatively low-pressure oil from the inlet of the pump 114 to enter the associated hole 150, when the valve 120 is not energized. In other words, the valve 120 places the associated hole 150 and cylinder bank 151 in fluid communication with the inlet of the pump 114 when the valve 120 is not energized. As the relatively low-pressure oil from the inlet of the pump 114 is insufficient to force the associated actuating arm 112 against the borehole wall, the actuating arm 112 remains in (or near) its retracted position under this condition.

Energizing the valve 120 activates a solenoid within the valve 120. The solenoid reconfigures the flow path within the valve 120 so that the outlet of the valve 120 is placed in fluid communication with the outlet of the pump 114 by way of the second inlet 120*b* of the valve 120.

Energizing the valve 120 therefore causes the oil from the discharge of the pump 114 to be directed to the associated hole 150 and cylinder bank 151. The relatively high-pressure oil acts again the underside of the associated pistons 154, and causes the pistons 154 to move outwardly, against the actuating arm 112. The outward movement of the pistons 154 urges the actuating arm 112 outward. The restraint of the arm 112 exerted by the associated pin 158 causes the actuating arm 112 to pivot about the pin 158, toward its extended position.

An outwardly-facing surface portion 175 of the actuating arm 112 contacts the surface of the bore 17, i.e., the borehole wall, and exerts a force thereon in a first direction (see FIG. 15), due to the relatively high force exerted on the pistons 154 and the actuating arm 112 by the high-pressure oil at pump-discharge pressure. The surface of the bore 17 exerts a reactive force on the actuating arm 112, in a second direction substantially opposite the first direction. This force is denoted by the reference character "F" in FIG. 15. The reactive force F urges the drill bit 13 substantially in the second direction, thereby effecting directional drilling.

The surface portion 175 of the actuating arm 112 preferably is curved, to substantially match the curvature of the surface of the bore 17 (see FIGS. 12-15). This feature causes the contact forces to be distributed over a relatively large area on the actuator arm 112, and can thereby help to reduce wear of the actuating arm 112.

De-energizing the valve 120 causes the solenoid to reconfigure the flow path within the valve 120, so that the outlet of the valve 120 is placed in fluid communication with the inlet of the pump 114 by way of the first inlet 121*a* of the valve 120. As the relatively low-pressure oil from the inlet of the pump 114 is insufficient to force the associated actuating arm 112 against the borehole wall, the actuating arm 112 returns to its retracted position.

Details concerning the manner in which the extension and retraction of the actuating arms 112 is controlled during directional drilling are presented below.

The valves 120, when energized, subject the associated holes 50 and the cylinders 152 to a hydraulic pressure approximately equal to the discharge pressure of pump 112. The valves 120 do not otherwise regulate the hydraulic pressure. Alternative embodiments can be equipped with proportional valves that can change the pressure and flow to the holes 150 and cylinders 152 in response to a control input to the valve. This feature can be used, for example, to maintain a desired pressure and flow rate to the holes 150 and cylinders 152 as the pump 114 wears or otherwise deteriorates.

The cylinders 152 preferably are oriented at an angle of approximately ninety degrees in relation to the radial direction of the housing 122 (see FIG. 12). In other words, the longitudinal axis of each cylinder 152 preferably is disposed at an approximate right angle in relation to a reference line that extends radially outward from the centerline of the housing 122 and intersects the cylinder 154. The feature helps to maximize the length of cylinders 152, the stroke of the pistons 154, and the actuating force generated by the pistons 154.

The actuating arms 112 preferably are formed from a relatively hard, wear-resistant material capable of withstanding the contact forces generated when the actuating arm 112 contacts the borehole wall. For example, the actuating 112 arms can be formed from 17-4PH stainless steel, or other suitable materials. A wear coating, such as a tungsten carbide coating (or other suitable coatings) can be applied to the surfaces of the actuating arms 112 that contact the borehole wall and the pistons 154, to provide additional durability.

The bypass valve 144 is configured to route the discharge of the pump 114 to the inlet of the pump 114 when the pressure of the oil in the manifold 143 exceeds a predetermined value. The bypass valve 144 can accomplish this bypass function by placing the first and second annuli 143*a*, 143*b* in fluid communication so that oil can flow from the second annulus 143*b* to the first annulus 143*a*. The predetermined value should be chosen so that the bypass valve 144 performs its bypass function when none of the three valves 120 is activated, i.e., when outlet of pump 114 is not in fluid communication with any of the cylinder banks 151. This feature can reduce the potential for deadheaded oil to cause an overpressure condition in the third hydraulic circuit.

Alternative embodiments of guidance module 110 can include more, or less than three actuating arms 112 and cylinder banks 151. Moreover, each cylinder bank 151 can include more, or less than three cylinders 152 in alternative embodiments. The actuating arms 112 and cylinder banks 151 can be circumferentially spaced in unequal angular increments in alternative embodiments.

A thrust bearing 176 and a spacer 178 are mounted between a lip formed on the housing 122 of the guidance module 110, and a neck 99*a* of the lower drive shaft 99 (see FIG. 6). The thrust bearing 176 preferably is a spherical roller bearing. The thrust bearing 176 transfers axial loads between the lower drive shaft 99 and the housing 120 during drilling operations. The thrust bearing 176 thus transfers the axial force exerted on the drill collar 14 to advance the drill bit 13 into the earth formation 16. The thrust bearing 176 is lubricated by the oil from the first hydraulic circuit. The oil reaches the thrust bearing 176 by way of various passages and clearances within the guidance module 110 and other components of the system 10.

The guidance module 110 also includes an alternator 180. The alternator 180 is mounted on the housing 122, within a cavity 182 formed in the housing 122. The cavity 182 is covered and sealed by a hatch cover 184 (see FIGS. 2, 6, and 14). The alternator 180 generates electrical power for the controller 118 and the other electrical components of the system 10. The alternator 180 preferably is a three-phase alternator that can tolerate the temperatures, pressures, and vibrations typically encountered in a down-hole drilling environment.

The alternator 180 is driven by the lower drive shaft 99, by way of a gear train 186. The gear train 186 is mounted on the housing 122, within the cavity 182. A portion of the lower drive shaft 99 has teeth 188 formed thereon (see FIG. 6). The teeth 188 engage a complementary gear of the gear train 186, so that rotation of the lower drive shaft 99 in relation to the housing 122 causes the teeth 188 to drive the gear train 186. Preferably, the gear train 186 is configured to drive the alternator 180 at a rotational speed approximately thirteen times greater than the rotational speed of the lower drive shaft 99.

The cavity 182 is filled with oil from the first hydraulic circuit. The oil lubricates the alternator 180 and the gear train 186. The oil reaches the cavity 182 by way of various passages and clearances within the guidance module 110 and other components of the system 10.

The controller 118 is mounted in a cavity 201 formed in the housing 122 (see FIG. 13). The cavity 201 is covered and sealed by a hatch cover 202.

The guidance module 110 also includes a voltage regulator board 204 (see FIGS. 6, 13, and 17). The voltage regulator board 204 is mounted in a cavity 206 formed in the housing 122. The cavity 206 is covered and sealed by a hatch cover 208.

The voltage regulator board 204 comprises a rectifier and a voltage regulator. The rectifier receives the alternating-current (AC) output of the alternator 180, and converts the AC output to a direct-current (DC) voltage. The voltage regulator regulates the DC voltage to a level appropriate for the controller 118 and the other electrical components powered by the alternator 180.

Wiring (not shown) that interconnects the alternator 180 with the voltage regulator board 204 is routed through a header 215, and through a passage 216 formed in the housing 122 between the cavities 182, 206 (see FIG. 6). The header 215 isolates the pressurized oil in the cavity 182 from the air at atmospheric pressure within the cavity 202.

The guidance module 110 also includes a short-hop circuit board and transducer 220 (see FIGS. 13 and 17). The short-hop circuit board and transducer 220 is mounted in a cavity 222 formed in the housing 122. The cavity 222 is covered and sealed by a hatch cover 224. The short-hop circuit board and transducer 220 is communicatively coupled to the controller 118 via wiring (not shown). The short-hop circuit board and transducer 220 facilitates communication between the controller 118 and the controller 322 of the mud-pulse telemetry system 321, via short-range telemetry.

The guidance module 110 also includes a valve control and magnetometer board 226 (see FIGS. 14 and 17). The valve control and magnetometer board 226 is mounted in a cavity 228 formed in the housing 122. The cavity 228 is covered and sealed by a hatch cover 230. The valve control and magnetometer board 226 is communicatively coupled to the controller 118 by wiring (not shown), and energizes the valves 120 in response to commands from the controller 118.

The valve control and magnetometer board 226 can also include a biaxial magnetometer that facilitates calculation of tool face angle, as discussed below.

The controller 118, voltage regulator board 204, short-hop circuit board and transducer 220, and valve control and magnetometer board 226 can be isolated from shock and vibration as required, by a suitable means such as a suspension.

Figure 8:
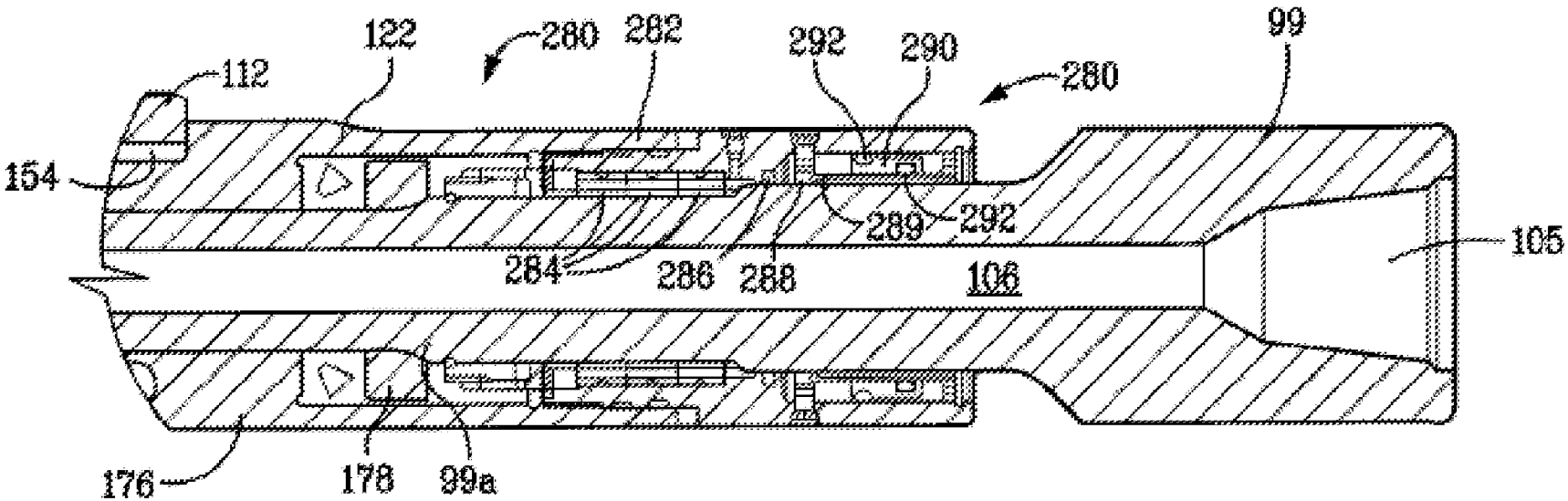
FIG. 8 is a magnified cross-sectional view of the area designated "G" in FIG. 6.

The system 10 also comprises a lower seal bearing pack assembly 280 (see FIGS. 6 and 8). The assembly 280 comprises a housing 282. The housing 282 is secured to the housing 122 of the guidance module 110 by a suitable means such as a threaded connection, so that the housing 122 rotates with the housing 122. The housing 282 thus forms part of the drill collar 14. The lower drive shaft 99 extends through the housing 282.

The assembly 280 comprises three radial bearings 284 for substantially centering the lower drive shaft 99 within the housing 282. The bearings 284 are lubricated by the oil from the first hydraulic circuit. The oil reaches the bearing 284 by way of various passages and clearances formed in the guidance module 100 and other components of the system 10.

The assembly 280 also comprises a first and a second seal 286, 288. The first and second seals 286, 288 can be, for example, rotary shaft lip seals or rotary shaft face seals.

The first and second seals 286, 288 are positioned around the lower drive shaft 99. The first seal 286 is located within an annulus formed in the housing 282. An up-hole end of the first seal 286 is exposed to the oil used to lubricate the bearings 284, i.e., the oil in the first hydraulic circuit. An up-hole end of the first seal 286 is exposed to oil contained within a fourth hydraulic circuit. The second seal 288 substantially isolates the oil in the first hydraulic circuit from the oil in the fourth hydraulic circuit.

The oil in the fourth hydraulic circuit, while isolated from the oil in the first hydraulic circuit, can be the same type of oil used in the first hydraulic circuit.

The second seal 288 is located within an annulus formed in a piston shaft 289 (see FIG. 8). The piston shaft 289 is positioned within the housing 282. An up-hole end of the second seal 288 is exposed to the oil in the fourth hydraulic circuit. A down-hole end of the second seal 288 is exposed to drilling mud, as annulus pressure. The second seal 288 substantially isolates the oil from the drilling mud.

A piston 290 is positioned around the piston shaft 289, so that the piston 290 can translate axially in relation to the piston shaft 289. An up-hole face of the piston 290 is exposed to the oil in the fourth hydraulic circuit. A down-hole face of the piston 290 is exposed to the drilling mud in the annular passage 19 formed between the drill collar 14 and the surface of the bore 17. O-ring seals 292 are positioned around the inner and outer circumference of the of piston 290. The O-ring seals 292 substantially isolate the oil from the drilling mud, and thereby reduce the potential for contamination of the oil by the drilling mud.

The pressurization of the oil in the fourth hydraulic circuit by the piston 290 substantially equalizes the pressure across the second seal 288. Equalizing of the pressure across the second seal 288 can discourage infiltration of the drilling mud into the fourth hydraulic circuit, and can reduce the rate of wear of the second seal 288 resulting from by contact with the lower drive shaft 99.

The pressurization of the oil in the fourth hydraulic circuit by the piston 290 also substantially equalizes the pressure across the first seal 286, and can reduce the rate of wear of the first seal 286 resulting from by contact with the lower drive shaft 99.

Further operational details of the system 10 are as follows. The casing 122 of the guidance module 110 forms part of the drill collar 14, a discussed above. The casing 122, and the attached actuating arms 112, therefore rotate in response to the torque exerted on the drill string 12 by the drilling rig 15, in the direction denoted by the arrow 300 in FIGS. 12 and 15 and at a speed equal to the rotational speed of the drill collar 14.

The actuating arms 112 are in their retracted positions during straight-hole drilling. Directional drilling can be achieved by selectively extending and retracting each actuating arm 112 on a periodic basis, so that the drill bit 13 is pushed in the desired direction of drilling. Each arm 112 can be extended and retracted once per revolution of the housing 122. Alternatively, each arm 112 can be extended and retracted once per a predetermined number of revolutions. The optimal frequency of the extension and retraction of the actuating arms 112 can vary with factors such as the pressure and flow rate of the oil or other hydraulic fluid used to actuate the actuating arms 112, the amount of angle built each time he actuating arms 112 are extended, etc.

The extension and retraction of the actuating arms 112 is effectuated by energizing and de-energizing the associated valves 120, as discussed above. This process is controlled by the controller 118. In particular, the controller 118 can determine the instantaneous angular orientation of each actuating arm 112 based on the tool face angle of the housing 122. The controller 118 includes algorithms that cause the controller 118 to energize and de-energize each valve 120 as a function of its angular position. The controller 118 determines the angular positions at which the valves 120 are energized and de-energized based on the desired direction of drilling, and the lag between energization of the valve and the point at which the valve is fully extended.

For example, the drill bit 13 can be guided in the 270° direction denoted in FIG. 15 by actuating each actuating arm 112 so that the actuating arm 112 is fully extended as the actuating arm 112 passes the 90° position. The resulting contact between the extended actuating arm 112 and the borehole wall causes the wall to exert a reactive force F that acts in a direction substantially opposite the 90° direction, i.e., the force F acts substantially in the 270° direction. The force F is transferred to the housing 122 through the actuating arm 112 and its associated pin 158. The force F is subsequently transferred to the drill bit 13 by way of the drive shaft assembly 31, and the various bearings that restrain the drive shaft assembly 31. The force F thereby urges the drill bit 13 in the 270° direction.

FIG. 15 depicts a first of the actuating arms 112, designated 112', at the 90° position. The actuating arm 112' is shown in its fully extended position, to urge the drill bit 13 in the 270° direction. A second of the actuating arms 112, designated 112", is located at the 210° position, since the actuating arms 112 are spaced apart in angular increments of approximately 120°. A third of the actuating arms 112, designated 112'", is located at the 330° position. The second and third actuating arms 112", 112'" are retracted at this point, and therefore do not exert any substantial forces on the borehole wall.

Since the drill string 12 can rotate at a relatively high speed (250 rpm or greater), the actuating arms 112 should be extended and retracted in a precise, rapid sequence, so that the actuating arms 112 push the drill bit 13 in the desired direction. In the example depicted in FIG. 15, the first actuating arm 12' should begin retracting immediately after reaching the 90° position, so that force F acts primarily in the desired direction, i.e., in the 270° direction.

The third actuating arm 112'" should begin extending at a predetermined distance from the 90° position, so that the third actuating arm 112'" is fully extended upon reaching the 90° position. The predetermined distance is a function of the lag time between the activation of the associated valve 120, and the point at which the actuating arm 112 reaches its fully extended position. The lag time is application dependent, and can vary with factors such as the discharge pressure of the pump 114, the size and weight of the actuating arms 112, the size of the holes 150 and cylinders 152, etc. A specific value for the predetermined distance therefore is not specified herein.

The accumulators 142 provide a reservoir of the relatively high-pressure oil used to actuate the actuating arms 112. Moreover, the pistons 145 help to ensure that the pressure in the accumulators 142 remains above bore pressure as the valve 120 is energized and the oil within the accumulators is drawn into the associated hole 150. The accumulators 142 can thereby help to minimize the lag time between activation of the valve 120 and the point at which the associated actuating arm 112 is fully extended, by ensuring that a sufficient amount of high-pressure oil is available to actuate the actuator arms 112.

The second actuating arm 112" should remain retracted as the first and third actuating arms 112', 112'" are retracting and extending, respectively, so that the second actuating arm 112" does not exert any substantial force on the drill bit 13 during this period.

Each actuating arm 112 preferably has features that help urge the actuating arm 112 toward the retracted position as the bottom hole assembly 11 is removed from the bore 17, to help minimize the potential for the actuating arms 112 to be damaged by, or become stuck against the borehole wall. For example, the up-hole end of each actuating arm 112 can be chamfered, and/or can have a helical curvature that causes the actuating arm 112 to move toward the retracted position as the housing 122 of the guidance module 110 is pulled up-hole or rotated during removal from the bore 17.

The signal processor 334 of the MWD tool 300 can be configured to calculate tool face angle based on the azimuth and inclination measurements obtained from the magnetometers 330 and accelerometers 332, using conventional techniques known to those skilled in the art of underground drilling. Alternatively, tool face angle can be calculated based on the techniques described in U.S. provisional application entitled "Method and Apparatus for Measuring Instantaneous Tool Orientation While Rotating," Ser. No. 60/676,072, filed Apr. 29, 2005, the contents of which is incorporated by reference herein in its entirety.

The calculated tool face angle can be transmitted from the signal processor to the controller 118 by way of the short-hop telemetry device 336, and the short-hop circuit board and transducer 220.

Information and commands relating to the direction of drilling can be transmitted between the surface and the system 10 using the mud-pulse telemetry system 321, short-hop telemetry device 336, and the short-hop circuit board and transducer 220 (see FIG. 17).

The pulser 323 of the mud-pulse telemetry system 321 can generate pressure pulses in the drilling mud being pumped through the drill collar 14, using techniques known to those skilled in the art of underground drilling. The controller 322 can encode the directional information it receives from the controller 118 as a sequence of pressure pulses, and can command the pulser 323 to generate the sequence of pulses in the drilling mud, using known techniques.

A strain-gage pressure transducer (not shown) located at the surface can sense the pressure pulses in the column of drilling mud, and can generate an electrical output representative of the pulses. The electrical output can be transmitted to surface control system 17, which can decode and analyze the data originally encoded in the mud pulses. The drilling operator can use this information, in conjunction with predetermined information about the earth formation 16, and the length of the drill string 12 that has been extended into the bore 17, to determine whether, and in what manner the direction of drilling should be altered.

Pulsers suitable for use as the pulser 323 are described in U.S. Pat. No. 6,714,138 (Turner et al.), and U.S. application Ser. No. 10/888,312, filed Jul. 9, 2004 and titled "Improved Rotary Pulser for Transmitting Information to the Surface From a Drill String Down Hole in a Well." A technique for generating, encoding, and de-coding pressure pulses that can be used in connection with the mud-pulse telemetry system 321 is described in U.S. application Ser. No. 11/085,306, filed Mar. 21, 2005 and titled "System and Method for Transmitting Information Through a Fluid Medium." Each of these patents and applications is incorporated by reference herein in its entirety.

Pressure pulses also can be generated in the column of drilling mud within the drill string 12, by a pulser (not shown) located on the surface. Directional commands for the system 10 can be encoded in these pulses, based on inputs from the drilling operator.

The pressure pulsation sensor 324 can sense the pressure pulses, and can send an output to the controller 322 representative of the sensed pressure pulses. The controller 322 be programmed to decode the information encoded in the pressure pulses. This information can be relayed to the controller 118 by the short-hop telemetry device 336 of the MWD tool 300, and the short-hop circuit board and transducer 220, so that the controller 118 can direct the drill bit 13 in a direction commanded by the drilling operator.

A pressure pulsation sensor suitable for use a the pressure pulsation sensor 324 is disclosed in U.S. Pat. No. 6,105,690 (Biglin, Jr. et al.), which is incorporated by reference herein in its entirety.

The switching device 326 senses whether drilling mud is being pumped through the drill string 12. The switching device 326 is communicatively coupled to the controller 322. The controller 322 can be configured to store data received from the controller 118 and the other components of the MWD tool 300 when drilling mud is not being pumped, as indicated by the output of the switching device 326. The controller 322 can initiate data transmission when the flow of drilling mud resumes. A suitable switching device 326 can be obtained from APS Technology, Inc. as the FlowStat™ Electronically Activated Flow Switch.

Additional information concerning the manner in which the actuating arms 112 can be extended and retracted to guide the drill bit 13 in a desired direction can be found in U.S. Pat. No. 6,257,356 (Wassell).

Alternative embodiments of the system 10 can be configured so that the guidance module 110 can be located more remotely from the drill bit 13 than in the system 10. Extending the actuating arms 112 in a system configured in this manner adds curvature to the bottom-most portion of the drill string 12, and thereby tilts the drill bit 13. Systems that operate by tilting the drill bit 13 are sometimes referred to as "three point systems" or "point the bit" systems. The drill bit 13 of a three-point system does not require side-cutting capability.

Figure 18:
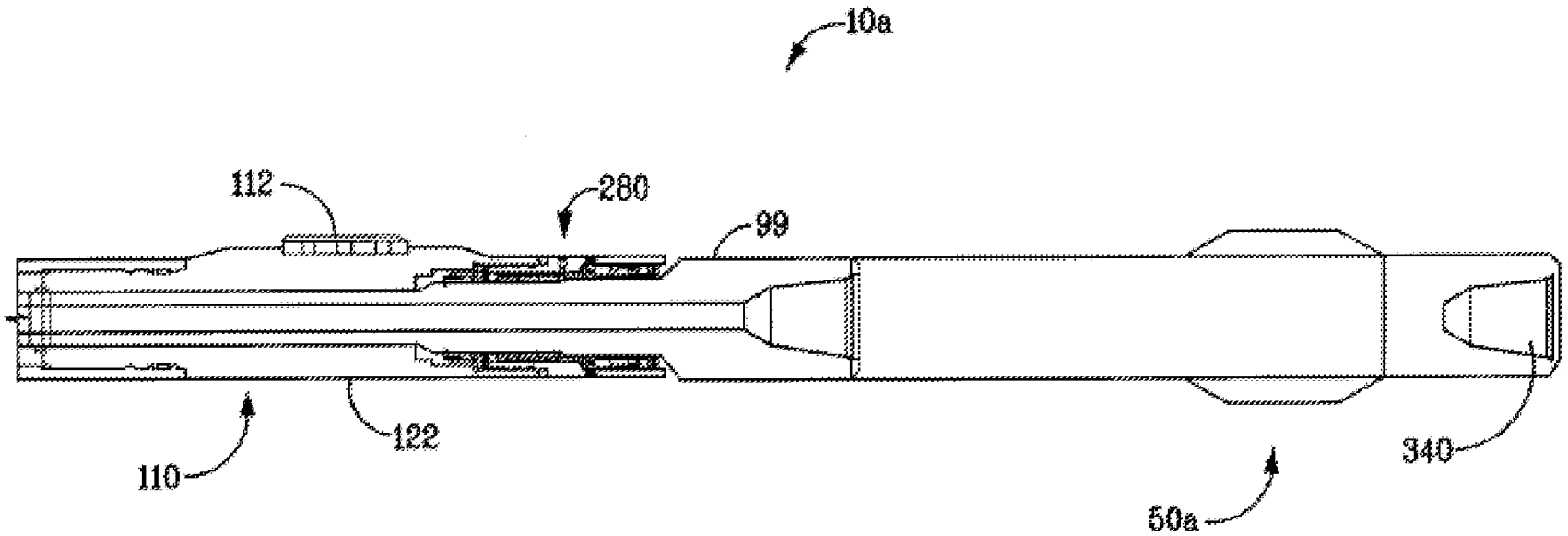
FIG. 18 is a longitudinal cross-sectional view of an alternative embodiment of the rotary steerable motor system shown in FIGS. 1-17.

An example of a three point system **10*a* is depicted in FIG. 18. The system 10*a* has a fixed-blade stabilizer 50*a* secured to the lower drive shaft 99 so that the stabilizer 50*a* rotates with the drive shaft assembly 31. A bit box 340 is secured to the down-hole end of the stabilizer 50*a* to accommodate the drill bit 13**.

The system 10 (and the system **10*a*) can facilitate directional drilling using a drilling motor, without a need for a bent drilling-motor housing or a bent subassembly. Hence, the drill string 12 can drill an in-gauge bore 18** during straight-hole drilling, in contradistinction to a conventional steerable system.

Moreover, as the drill string 12 rotates during directional drilling, the drill string 12 does not need to slide during directional drilling. Hence, it is believed that the drill string 12 can achieve a relatively high rate of penetration during directional drilling, in comparison to a conventional steerable system. Moreover, it is believed that the drill string 12 is not subject to the bit whirl, stick slip, and cuttings-removal difficulties that can be prevalent in conventional steerable systems during directional drilling.

The use of a drilling motor such as the drilling motor 25 in the system 10 can substantially increase the power available to rotate the drill bit 13, in comparison to a conventional rotary steerable tool that does not include a drilling motor. Hence, it is believed that the rate of penetration of a drill string equipped with the system 10 is substantially higher than the rate of penetration of a comparable drill string equipped with a conventional rotary steerable tool.

Moreover, the system 10 allows the drill bit 13 to rotate at velocity different than the rotational velocity of the drill collar 14. Hence, the drill bit 13 can be rotated at a relatively high velocity that results in relatively high rate of penetration, while the housing 122 of the guidance module 110 can rotate at a relatively low velocity suitable for contact between the arms 112 and the surface of the bore 17.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

PARTS LIST

Rotary steerable motor system 10
Bottom hole assembly 11
Drill string 12
Drill bit 13
Drill collar 14
Drilling rig 15
Earth formation 16
Bore 17
Pump 18
Passage 19
Surface control system 20
Motor 21 (of drilling rig 15)
Turntable 22
Drilling motor 25
Housing 26 (of drilling motor 25)
Stator 27
Rotor 28
Flexible coupling 30
Drive-shaft assembly 31
First universal joint 32 (of flexible coupling 30)
Shaft 34
Second universal joint 36
Housing 38
Passage 39 (between housing 38 and flexible coupling 30)
Diverter 40
Passages 42, 44 (in diverter 40)
Internal volume 49
Stabilizer 50
Body 51 (of stabilizer 50)
Blades 52 (of stabilizer 50)
Upper drive shaft 53
Passage 54 (in upper drive shaft 53)
Compensation and upper seal bearing pack assembly 70
Housing 71 (of assembly 70)
Bearing support 72
Bearings 76
Piston 80
Piston shaft 82
Mounting ring 84
Spring 86
Spring retainer 87
Internal volume 88
Internal volume 89
O-ring seals 90
Seals 92, 94
Seal housing 95
Piston 96
O-ring seals 98
Lower drive shaft 99 (of drive shaft assembly 31)
Neck 99*a* (of lower drive shaft 99)
Crossover subassembly 100
Housing 101 (of crossover subassembly 100)
Bearing 102
Spacer 103
Bearings 104
Bit box 105
Passage 106 (in lower drive shaft 99)
Guidance module 110
Actuating arms 112 (of guidance module 110)
Hydraulic pump 114
Controller 118
Valves 120
First inlet 121*a* (of valves 120)
Second inlet 121*b*
Housing 122
Lip 122*a*
Bearings 124
Stator 127 (of pump 114)
Rotor 128
Bearing seal housing 129
Manifold 130
Inlet port 131*a* (in manifold 130)
Outlet port 131*b*
Vanes 132
Grooves 133 (in rotor 128)
Cam lobes 134 (on stator 127)
Splines 135 (on lower drive shaft 99)
Splines 136 (on rotor 128)
Pistons 139
Hydraulic manifold assembly 140
Body 141 (of hydraulic manifold assembly 140)
Accumulators 142
First annulus 143*a*
Second annulus 143*b*
Bypass valve 144
Pistons 145
Bores 146 (in body 141)
Bearing 148
Crush ring 149
Holes 150
Cylinder banks 151
Cylinders 152
Pistons 154
Seals 157
Pins 158
Recesses 160 (in housing 122)
Ports 161 (in body 41 of hydraulic manifold assembly 140)
Casing 162 (of hydraulic manifold assembly 140)
Grooves 163*a*, 163*b* (in body 141)
Passages 165*a*, 165*b*

Passages 166
Bore 167
Curved surface portions 175 (of actuating arms 112)
Thrust bearing 176
Spacer 178
Alternator 180
Cavity 182
Hatch cover 184
Gear train 186
Teeth 188 (of gear train 186)
Cavity 201
Hatch cover 202
Voltage regulator board 204
Cavity 206
Hatch cover 208
Header 215
Passage 216
Sort-hop circuit board and transducer 220
Cavity 222
Hatch cover 224
Valve control and magnetometer board 226
Cavity 228
Hatch cover 230
Lower seal bearing pack assembly 280
Housing 282 (of assembly 280)
Bearings 284
First rotating face seal 286
Second rotating face seal 288
Piston shaft 289
Piston 290
Seals 292
Measurement while drilling (MWD) tool 300
Mud-pulse telemetry system 321
Controller 322
Pulser 323
Pressure pulsation sensor 324
Switching device 326
Magnetometers 330
Accelerometers 332
Signal processor 334
Short-hop telemetry device 336
Bit box 340

What is claimed is:

1. A system for rotating and guiding a drill bit in an underground bore, comprising:

(a) a drilling motor comprising a housing, and a rotor mounted in the housing so that the rotor rotates in relation of the housing;

(b) a drive shaft coupled to the rotor and the drill bit so that the drill bit rotates in response to rotation of the rotor; and (c) a guidance module for guiding the direction in which the drill bit drills comprising:

(i) housing coupled to the housing of the drilling motor so that the housing of the guidance module rotates with the housing of the drilling motor, the drive shaft extending through the housing of the guidance module, (ii) a plurality of movable members mounted on the housing of the guidance module for applying force to the guidance module housing that guides the drilling direction of the drill bit, each of the movable members being movable in relation to the housing of the guidance module between an extended position wherein the movable member can contact a surface of the bore and thereby exert a force on the housing of the guidance module, and a retracted position;

(iii) an actuator for causing the movable members to periodically extend and retract in sequence as the guidance housing rotates.

2. The system of claim 1, wherein the actuator comprises a piston for each of the movable members, each piston movably disposed in a cylinder formed in the guidance module housing so that the piston can extend from the cylinder to actuate its respective movable member.

3. The system of claim 2, wherein the guidance module further comprises a hydraulic pump for pressurizing a fluid directed to the cylinders.

4. The system of claim 2, wherein the actuator comprises valve means for placing the cylinders in fluid communication with a pressurized fluid on a selective basis.

5. The system of claim 4, wherein the guidance module further comprises a hydraulic pump for pressurizing the pressurized, and wherein the valve means places each cylinder in fluid communication with an outlet and an inlet of the pump on an alternate basis.

6. The system of claim 4, wherein the valve means comprises a valve in fluid communication with a pump, and wherein the guidance module further comprises a hydraulic manifold assembly comprising a body having the valve mounted thereon, and a casing disposed around the body, the body having a first and a second groove formed therein, the first groove and the casing defining a first annulus, the first annulus being in fluid communication with an inlet of the pump, the second groove and the casing defining a second annulus, the second annulus being in fluid communication with an outlet of the pump.

7. The system of claim 6, wherein the hydraulic manifold assembly further comprises a bypass valve mounted on the body for placing the outlet of pump in fluid communication with the inlet of the pump on a selective basis.

8. The system of claim 1, further comprising a controller for activating the actuator so that each movable member extends and retracts as the housing of the guidance module rotates through a predetermined angular displacement.

9. The system of claim 8, wherein the controller activates the actuator so that each movable member is extended when the movable member is located at an angular orientation substantially opposite a desired direction of drilling.

10. The system of claim 8, wherein the actuator comprises a valve, and further comprising a valve control and magnetometer board communicatively coupled to the controller energizing the valve in response to commands from the controller.

11. The system of claim 10, wherein the valve control and magnetometer board further comprises a magnetometer.

12. The system of claim 8, further comprising a short-hop circuit board and transducer communicatively coupled to the controller for facilitating telemetric communications between the controller and a mud-pulse telemetry system.

13. The system of claim 1, wherein the guidance module further comprises an alternator, and a gear train coupled to the drive shaft and the alternator so that rotation of the drive shaft imparts a rotational input to the alternator.

14. The system of claim 13, further comprising a voltage regulator board comprising a rectifier electrically coupled to the alternator for converting an alternating-current output of the alternator to direct current voltage, a voltage regulator for regulating the direct current voltage.

15. The system of claim 1, wherein the drilling motor further comprises a stator secured to the housing so that a passage is formed between the rotor and the stator, and the rotor rotates in relation to the stator in response to the passage of the fluid through the drilling motor.

16. The system of claim 1, further comprising a first and a second seal concentrically disposed with and contacting the drive shaft, wherein a first side of the first seal is exposed to oil in a first hydraulic circuit of the system, a second side of the first seal is exposed to oil in a second hydraulic circuit of the system, a first side of the second seal is exposed to the oil in the second hydraulic circuit, and a second side of the second seal is exposed to a fluid that passes through the drilling motor, the system further comprising means for substantially equalizing a fluid pressure across the first and second seals.

17. The system of claim 1, further comprising means mounted on the housing of the guidance module for substantially centering the drive shaft within the housing of the guidance module.

18. The system of claim 17, wherein the means mounted for substantially centering the drive shaft within the housing of the guidance module is a radial bearing and the system further comprises a hydraulic system for lubricating the radial bearing.

19. The system of claim 1, wherein the drive shaft comprises a diverter, the diverter having a passage formed therein and angled in relation to an axis of rotation of the diverter for directing the fluid to a centrally-located, axially-extending passage within the diverter.

20. The system of claim 1, wherein the movable member is an arm pivotally coupled to the housing.

21. The system of claim 1, wherein the housing of the guidance module rotates with the housing of the drilling motor about an axis, and wherein the actuator causes the sequential extension of the movable members as a function of the angular orientation of the guidance module housing about its axis.

22. The system of claim 1, wherein the actuator causes the movable members to extend and retract in sequence once per revolution as the guidance module housing rotates.

23. The system of claim 1, wherein the actuator causes the movable members to extend and retract in sequence once per a predetermined number of revolutions as the guidance module housing rotates.

24. A system for rotating and guiding a drill bit in an underground bore, comprising:

(a) a drill string that rotates at a first rotary speed, the drill bit mounted on a distal end of the drill string;

(b) a drilling motor mounted in the drill string, the drilling motor comprising a housing and a rotor mounted in the housing, the drilling motor housing rotating along with the drill string at the first rotary speed, the rotor rotating in relation to the housing at a second rotary speed;

(c) a drive shaft coupled to the rotor and the drill bit so that drill bit rotates in response to rotation of the rotor at a third rotary speed that is the sum of the first and second rotary speeds; and (d) a guidance module for guiding the direction in which the drill bit drills while the drill bit rotates at the third rotary speed, the guidance module comprising:

(i) a housing coupled to the housing of the drilling motor so that the housing of the guidance module rotates with the housing of the drilling motor at the first rotary speed, the drive shaft extending through the housing of the guidance module, a pressurized fluid disposed within the guidance module housing;

(ii) a plurality of movable members disposed about the guidance module for applying force to the guidance module housing that guides the drilling direction of the drill bit, each of the movable members being movable in relation to the housing of the guidance module between an extended position wherein the movable member can contact a surface of the bore and thereby exert a force on the housing of the guidance module, and a retracted position, the extension of each movable member being caused by the pressurized fluid disposed within the guidance module housing;

(iii) valve means for directing the flow of pressurized fluid so as to cause the movable members to periodically and sequentially extend as the guidance module rotates at the first rotary speed.

25. The system of claim 24, wherein the guidance module further comprises a pump for pressurizing the pressurized fluid.

26. The system of claim 25, further comprising a piston for urging each movable member radially outward, each piston sliding within a cylinder.

27. The system of claim 26, wherein the pump has an outlet, and wherein the valve means comprises a valve for each cylinder, each valve placing its respective cylinder in flow communication with the outlet of the pump.

28. The system of claim 24, wherein the pressurized fluid is a hydraulic fluid.

* * * * *